US012446689B2

(12) United States Patent
Chen

(10) Patent No.: US 12,446,689 B2
(45) Date of Patent: Oct. 21, 2025

(54) GUIDE RAIL MECHANISM FOR AN ARTICLE OF FURNITURE

(71) Applicant: Foshan City Aresi Technology Co., Ltd., Foshan (CN)

(72) Inventor: Tsung-Yao Chen, New Taipei (TW)

(73) Assignee: FOSHAN CITY ARESI TECHNOLOGY CO., LTD., Foshan (CN)

( * ) Notice: Subject to any disclaimer, the term of this patent is extended or adjusted under 35 U.S.C. 154(b) by 154 days.

(21) Appl. No.: 18/309,589

(22) Filed: Apr. 28, 2023

(65) Prior Publication Data

US 2024/0000228 A1 Jan. 4, 2024

(30) Foreign Application Priority Data

Jun. 29, 2022 (TW) ..... 111124320

(51) Int. Cl.
*A47B 88/477* (2017.01)

(52) U.S. Cl.
CPC ..... *A47B 88/477* (2017.01)

(58) Field of Classification Search
CPC ..... A47B 88/407; A47B 88/475; A47B 88/40; A47B 2210/0056; A47B 2210/09; A47B 2210/091; A47B 2210/092
See application file for complete search history.

(56) References Cited

U.S. PATENT DOCUMENTS

| | | | | |
|---|---|---|---|---|
| 4,779,999 | A * | 10/1988 | Lautenschlager | F16C 29/04 384/57 |
| 5,588,729 | A * | 12/1996 | Berger | A47B 88/427 312/334.4 |
| 5,779,333 | A * | 7/1998 | Lautenschlager | A47B 88/43 312/334.14 |
| 8,585,165 | B2 * | 11/2013 | Liang | A47B 88/427 312/334.4 |
| 8,857,929 | B2 * | 10/2014 | Netzer | A47B 88/427 312/334.4 |
| 10,765,028 | B1 * | 9/2020 | Beall | H05K 7/1489 |
| 2001/0019235 | A1 * | 9/2001 | Hammerle | A47B 88/427 312/334.4 |
| 2007/0080617 | A1 * | 4/2007 | Lam | A47B 88/493 312/334.15 |
| 2017/0105525 | A1 * | 4/2017 | Klaus | A47B 88/427 |
| 2018/0160805 | A1 * | 6/2018 | Liang | A47B 88/407 |
| 2020/0329865 | A1 * | 10/2020 | Salice | A47B 88/407 |
| 2021/0186212 | A1 * | 6/2021 | Petker | A47B 88/407 |
| 2022/0196067 | A1 * | 6/2022 | He | F16C 29/046 |
| 2022/0304466 | A1 * | 9/2022 | He | A47B 88/447 |

* cited by examiner

*Primary Examiner* — Daniel J Rohrhoff
(74) *Attorney, Agent, or Firm* — HOWARD M COHN and Associates, LLC

(57) ABSTRACT

A guide rail mechanism includes a fixed rail unit, a movable rail unit slidably mounted on the fixed rail unit, and a tail hook projecting from a top side of the movable rail unit. The tail hook has an upwardly extending section extending upwardly from the movable rail unit, and an insert section extending forwardly from the upwardly extending section and having a taper portion tapered to terminate at a striking tip. The taper portion is deflected from a central line of a width to have the striking tip spaced apart from the central line and at a side away from a fixed wall. An adjusting space is formed when the guide rail mechanism is connected between a furniture carcass and a drawer.

2 Claims, 27 Drawing Sheets

GUIDE RAIL MECHANISM FOR AN ARTICLE OF FURNITURE

CROSS-REFERENCE TO RELATED APPLICATION

This application claims priority to Taiwanese Patent Application No. 111124320, filed on Jun. 29, 2022.

FIELD

The disclosure relates to a guide rail mechanism, and more particularly to a guide rail mechanism for guiding movement of a movable furniture part relative to a furniture carcass.

BACKGROUND

As shown in FIGS. 1 to 5, a conventional guide rail mechanism 100 generally includes a fixed rail 101 securely mounted on a lateral wall 201 of a furniture carcass 20, and a movable rail 103 slidably disposed on the fixed rail 101 in a front-rear direction and connected with a movable furniture part, such as a drawer 202. The fixed rail 101 has an upright fixed wall 102 which is securely mounted on the lateral wall 201 and extends in the front-rear direction. A rear end portion of the movable rail 103 has an L-shaped tail hook 104 which projects upwardly and is disposed rearwardly of the drawer 202. The tail hook 104 has an insert portion extending forwardly and terminating at a central forwardly extending tip 106 at a center of the tail hook 104 in a left-right direction. To install the drawer 202, two guide rail mechanisms 100 are prepared to respectively mount the fixed rails 101 of the guide rail mechanisms 100 on two lateral walls 201 of the furniture carcass 20, and the drawer 202 straddles the movable rails 103 of the guide rail mechanisms 100 to bring two upright plates 203 of the drawer 202 to respectively abut against back sides of the movable rails 103, and to bring the tail hooks 104 to be forwardly inserted into two aligning holes 204 in a rear wall of the drawer 202. Specifically, the upright plates 203 of the drawer 202 have lower inner abutting surfaces 205 which respectively abut against outer concealed walls 105 of the movable rails 103. The lower inner abutting surfaces 205 conceal the outer concealed walls 105 of the movable rails 103 to improve the outer appearance thereof.

To precisely align and insert the tail hooks 104 with and into the aligning holes 204, during the installation process, the movable rails 103 are moved forwardly to bring the central forwardly extending tips 106 of the tail hooks 104 to strike the rear wall of the drawer 202 so as to form two striking points 209 on the rear wall, and an appropriate drill 200 with a diameter similar to the width of the tail hooks 104 is used to form the aligning holes 204.

On the other hand, in a recent handleless cabinet design, a spring-biased push-to-open device is disposed on the guide rail mechanisms for performing the action of opening and closing the drawer. However, unstable action during opening and closing may occur, and an actuating gap is needed between the front panel 208 of the drawer 202 and a front side of the carcass 20, which may permit the entry of foreign matter. The front panel 208 of the drawer 202 has an operating slope at an upper edge to facilitate gripping and pulling out of the drawer 202. However, the operating slope is too small to be operated stably with the user's finger which is inconvenient.

In the conventional installation process, the width matching among the guide rail mechanisms 100, the carcass 20 and the drawer 202 for obtaining optimal size and diagonal arrangement may encounter many unpredictable errors so as to cause errors in the width of the drawer 202 and width differences between the front and rear parts of the drawer 202. As such, when the drawer 202 is mounted on the guide rail mechanisms 100, the front panel 208 of the drawer 202 in the closed state is slightly tilted relative to the front side of the carcass 20, as shown in FIG. 5 and FIGS. 15 and 16, so that one end of the front panel 208 is attached to the front side of the carcass 20 while the other end thereof is distant from the front side of the carcass 20 and forming a gap 207. Although a biasing spring (not shown) may be installed to increase the pulling force to minimize the gap 207, it unfortunately has the drawback of making it more difficult for the user to pull out the drawer 202. Such a solution also creates a dilemma. That is, while the application of the biasing spring for minimizing the gap will increase the difficult of opening the drawer 202, decreasing the spring force to facilitate opening the drawer 202 will cause the gap 207 to widen.

Moreover, referring to FIGS. 1, 3 and 4, since the outer concealed walls 105 of the movable rails 103 of the guide slide mechanisms 100 abut against the lower inner abutting surfaces 205 of the upright plates 203 of the drawer 202, it is still troublesome to improve the smoothness of opening and closing the drawer 202 through adjustment of the guide rail mechanisms 100, and/or to make an appropriate attachment of the front panel 208 (see FIG. 5) to the carcass 20. Additionally, the two guide rail mechanisms 100 are depressed horizontally and travel non-parallel. It is difficult but essential to solve these problems with one structure. Once the fixed rails 101 are fastened to the lateral walls 201 of the carcass 20, the outer concealed walls 105 of the movable rails 103 contact and are attached to the lower inner abutting surfaces 205 of the drawer 202 so that the movable rails 103 might be depressed or spreaded with an unexpected tolerance of the lower inner abutting surfaces 205 so as not to smoothly slide along the fixed rails 101.

SUMMARY

Therefore, an object of the disclosure is to provide a guide rail mechanism that can alleviate at least one of the drawbacks of the prior art.

According to the disclosure, the guide rail mechanism is connectable between a furniture carcass and a movable furniture part for guiding movement of the movable furniture part relative to the furniture carcass in a front-rear direction. The guide rail mechanism includes a fixed rail unit which has a fixed wall securely mountable on the furniture carcass, a movable rail unit which is slidably mounted on the fixed rail unit in the front-rear direction, and which is spaced apart from the fixed wall in a left-right direction, and a tail hook which projects from a top side of a rear end portion of the movable rail unit. The tail hook has an upwardly extending section which extends upwardly from the movable rail unit, and an insert section which extends forwardly from the upwardly extending section to terminate at a striking tip. The insert section is configured to have a largest width portion which connects with the upwardly extending section and which has a largest width of the insert section in the left-right direction, and a taper portion which extends and is gradually tapered from the largest width portion to the striking tip. The taper portion is deflected from a central line which extends in the front-rear direction and through a center of the largest width portion to form the striking tip spaced apart from the central line and at a side of the central line away from the fixed wall.

With the taper portion of the tail hook tapered and deflected from the central line of the width to have the striking tip spaced apart from the central line and away from the fixed wall, two lower inner abutting surfaces of the drawer are spaced apart from the corresponding outer concealed walls of the movable rail units of the guide rail mechanisms by adjusting spaces so as to overcome the drawbacks of the prior art.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
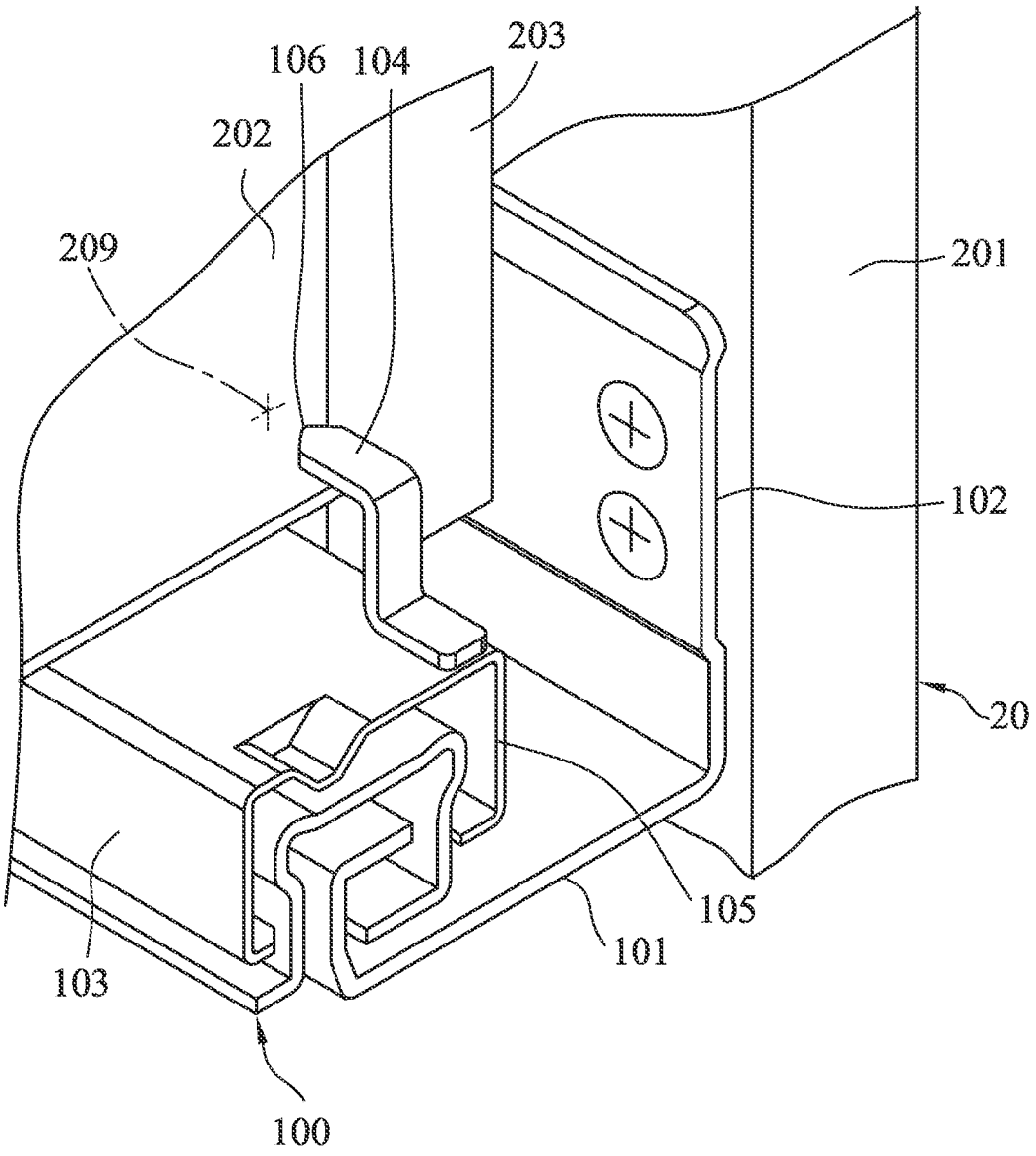
FIG.1 PRIOR ART
FIG. 1 is a fragmentary perspective view illustrating a conventional guide rail mechanism in a state when a tail hook is moved to strike a drawer during an installation process.
Figure 2:
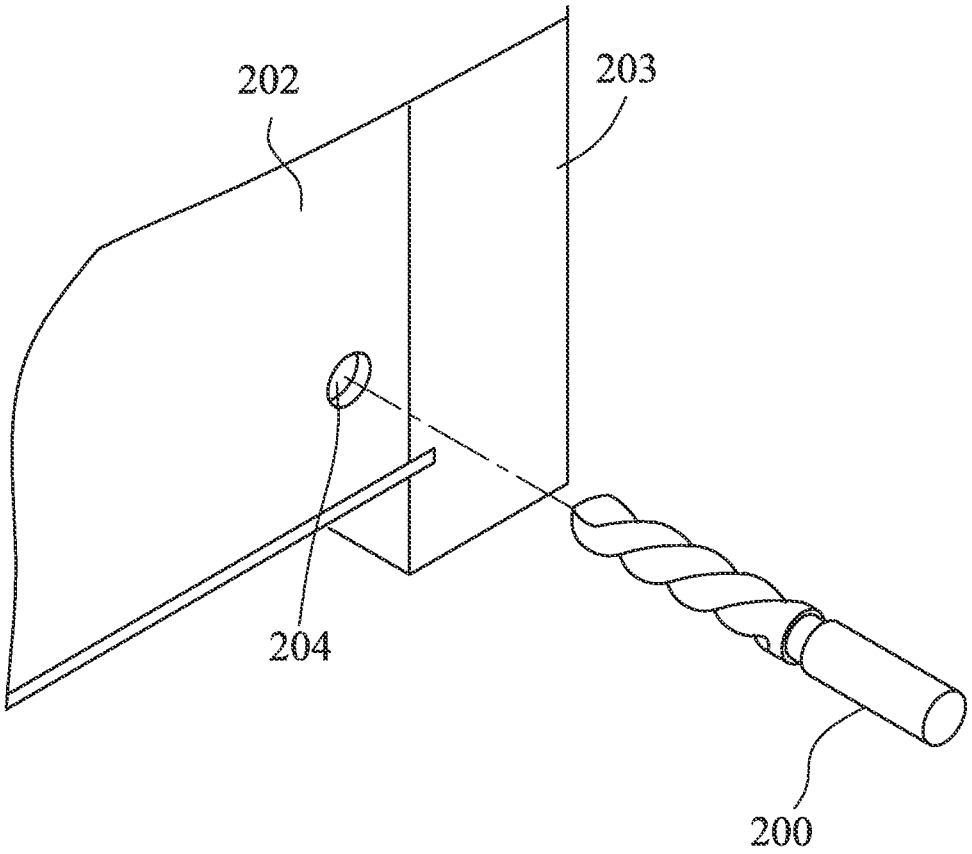
FIG.2 PRIOR ART
FIG. 2 is a fragmentary perspective view illustrating a drill operated to form an aligning hole at the striking point of the drawer.
Figure 3:
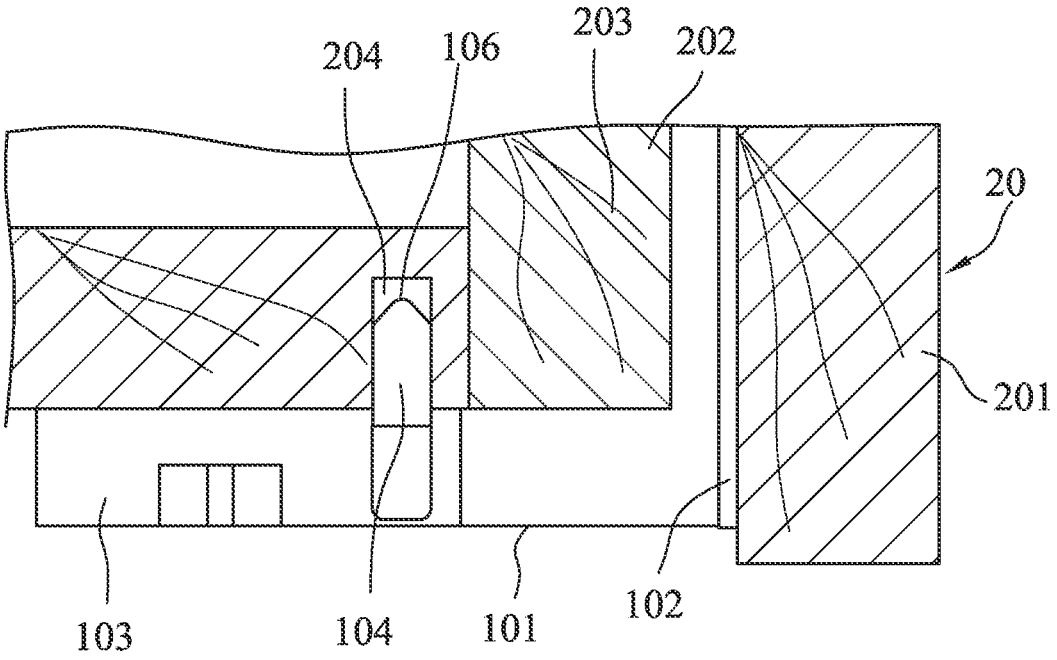
FIG.3 PRIOR ART
FIG. 3 is a fragmentary sectional view illustrating the tail hook of the conventional guide rail mechanism inserted into the aligning hole of the drawer.
Figure 4:
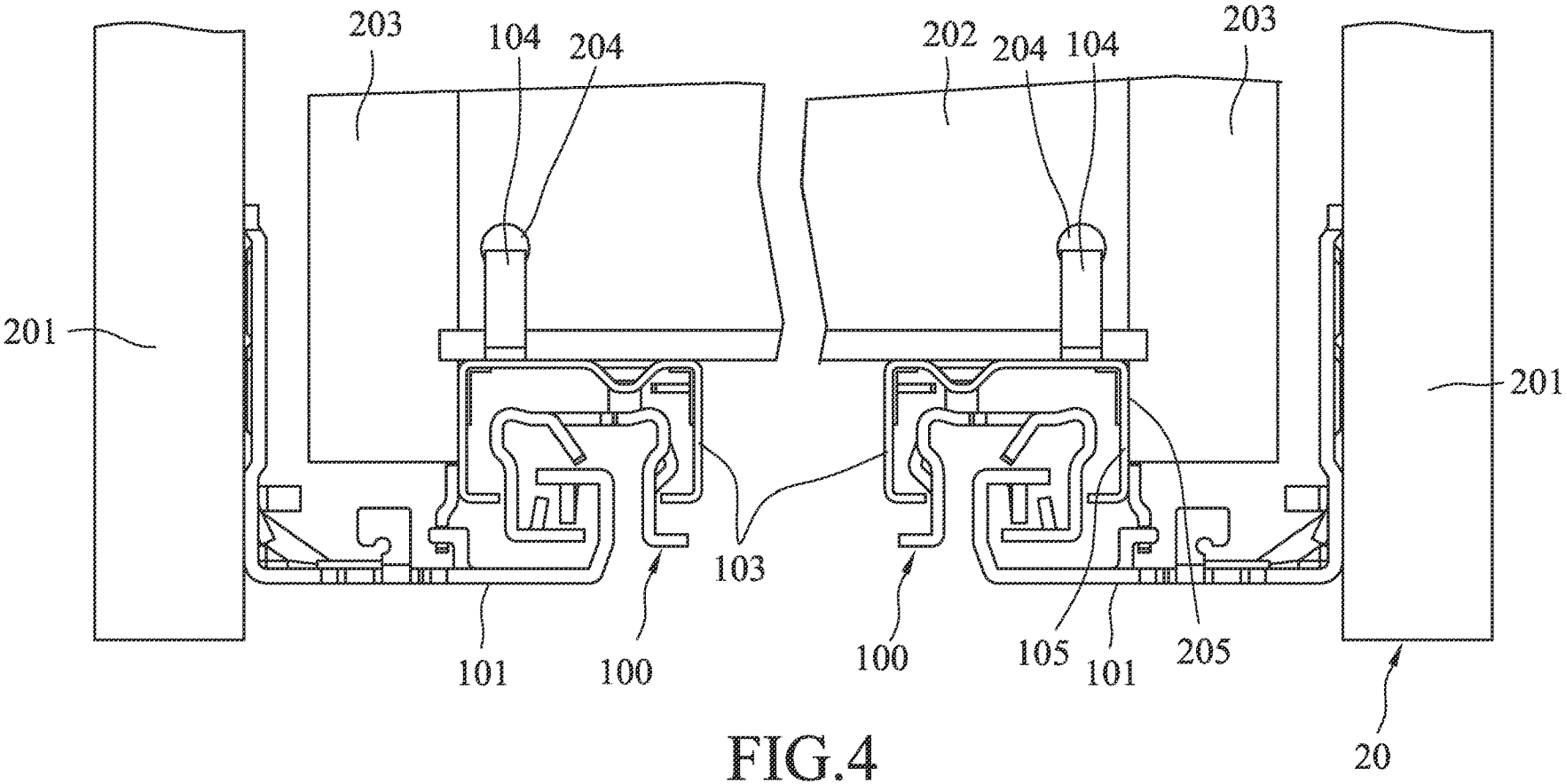
FIG.4 PRIOR ART
FIG. 4 is a fragmentary rear view illustrating two of the conventional guide rail mechanisms mounted on a furniture carcass and a drawer straddling the guide rail mechanisms.
Figure 5:
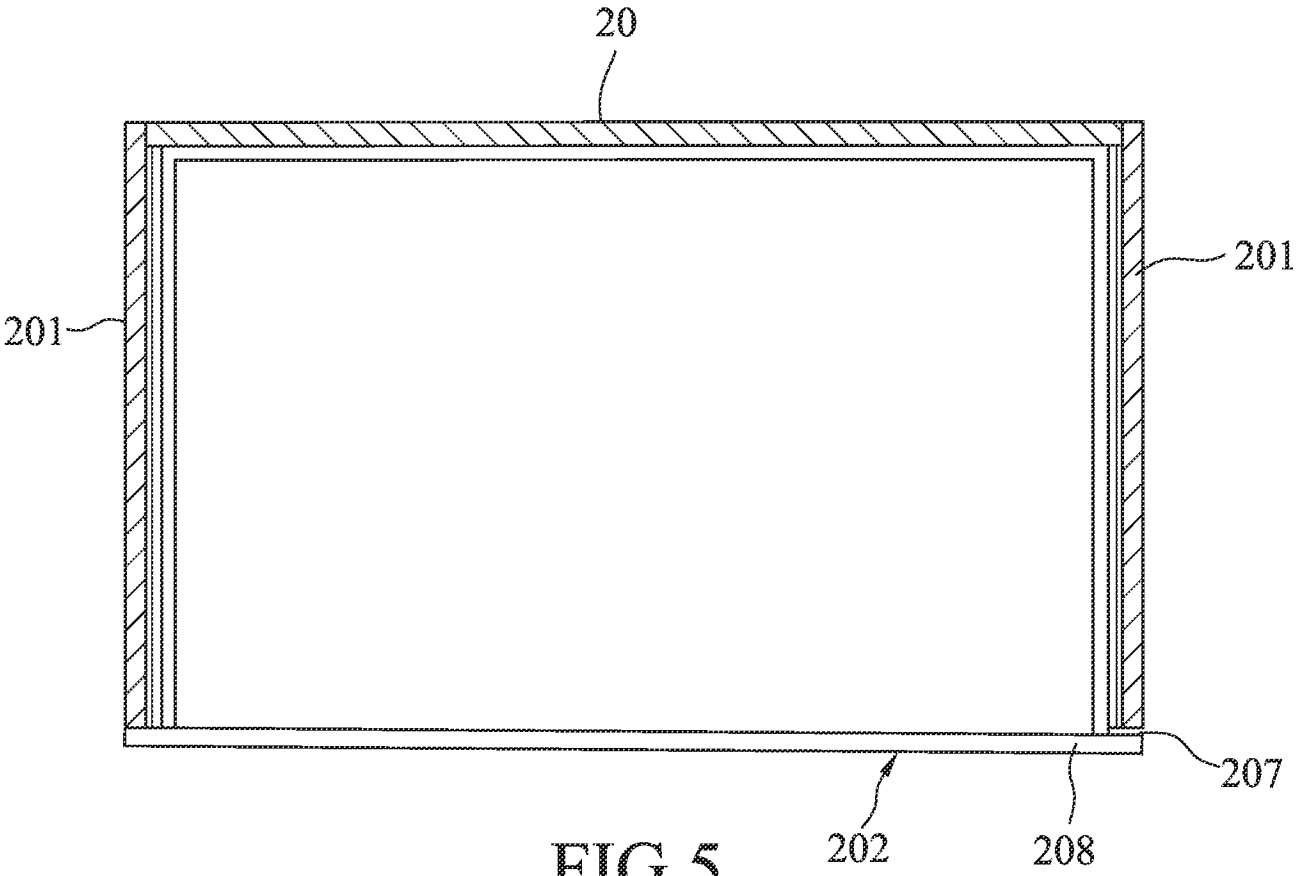
FIG.5 PRIOR ART
FIG. 5 is a sectional view illustrating the drawer received in the furniture carcass with one end of a front panel attached to the carcass while the other end is distant from the carcass by a gap.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 6:
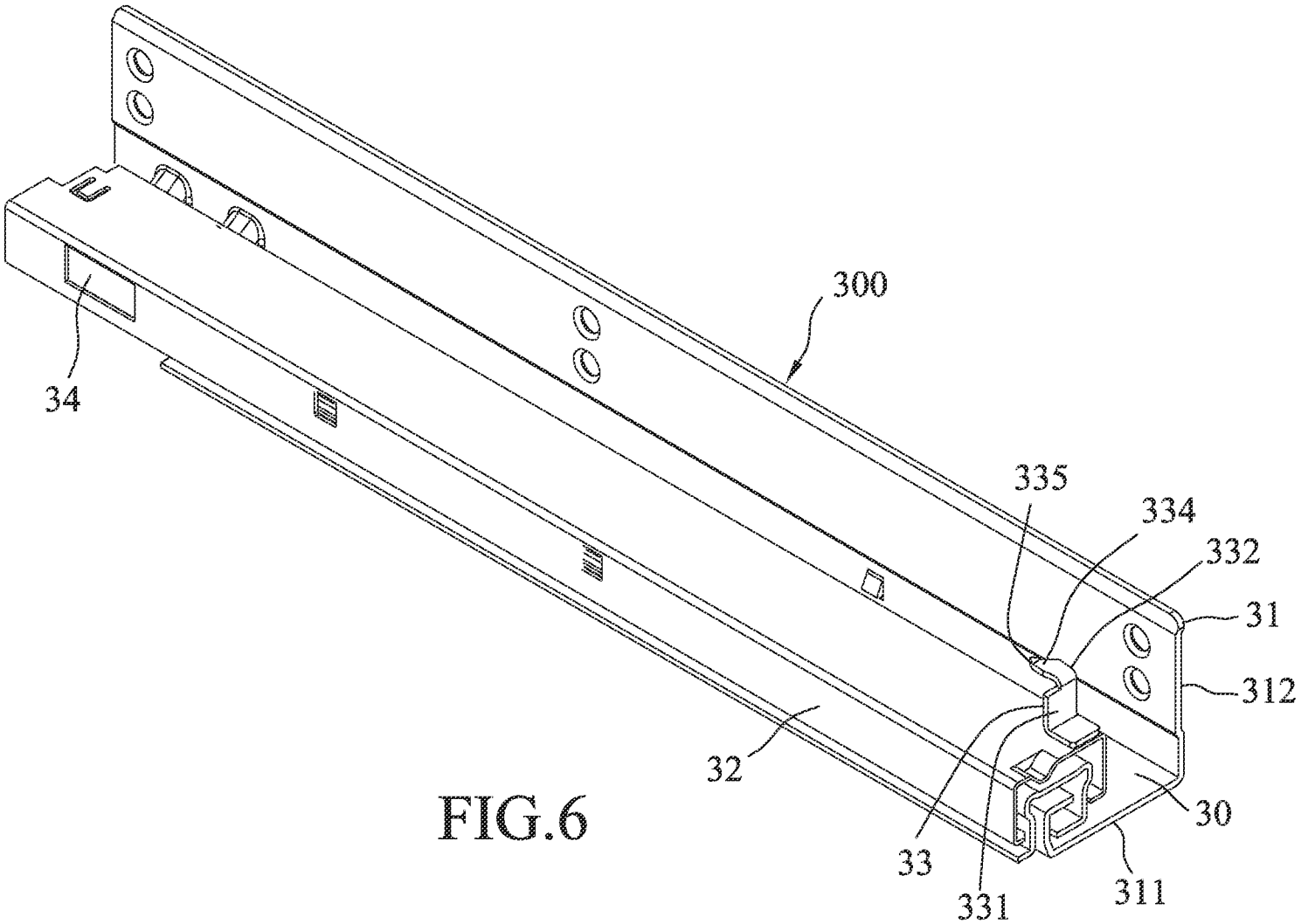
FIG. 6 is a perspective view illustrating an embodiment of a guide rail mechanism according to the disclosure.
Figure 7:
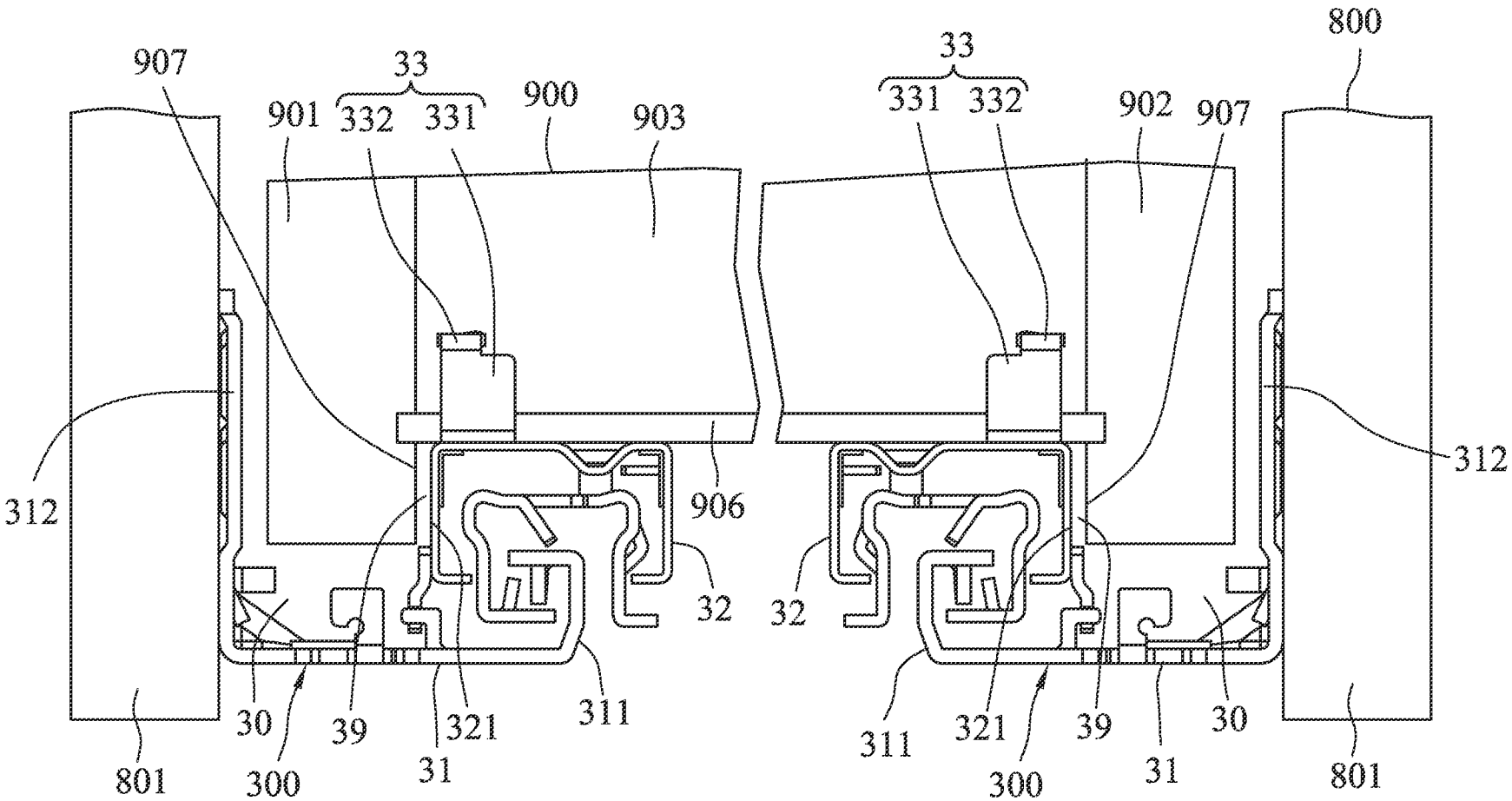
FIG. 7 is a fragmentary rear view illustrating two of the guide rail mechanisms of the embodiment mounted on a furniture carcass and a drawer straddled thereon.
Figure 8:
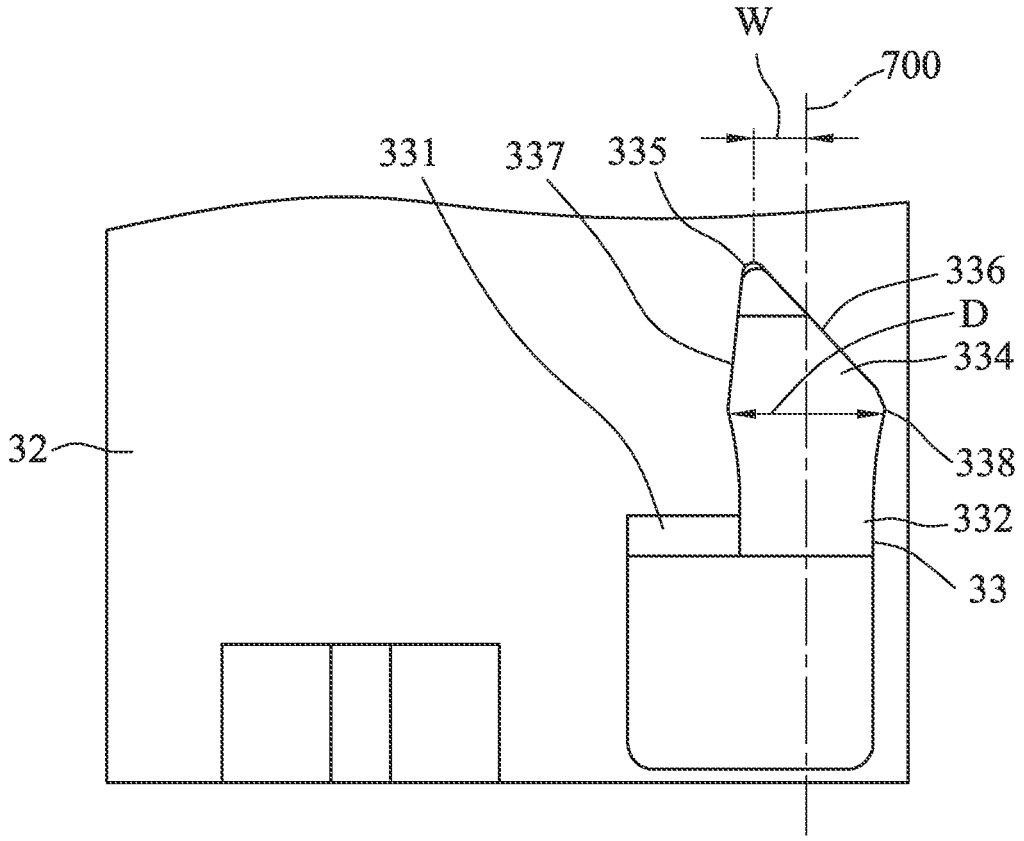
FIG. 8 is a fragmentary top view illustrating a tail hook of the embodiment.
Figure 12:
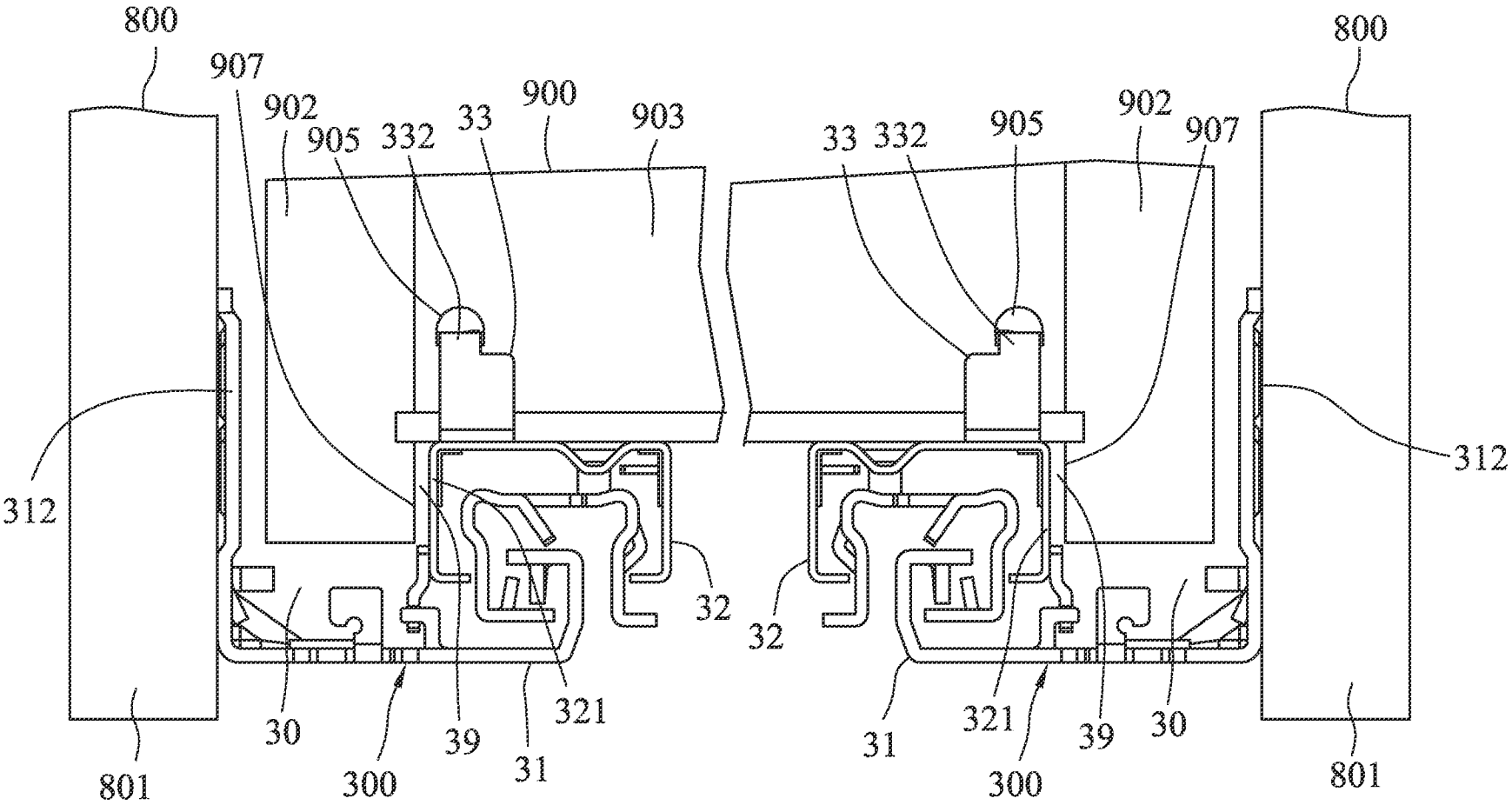
FIG. 12 is a fragmentary rear view similar to FIG. 7, illustrating two tail hooks of the guide rail mechanisms inserted into two aligning holes in the drawer.
Figure 13:
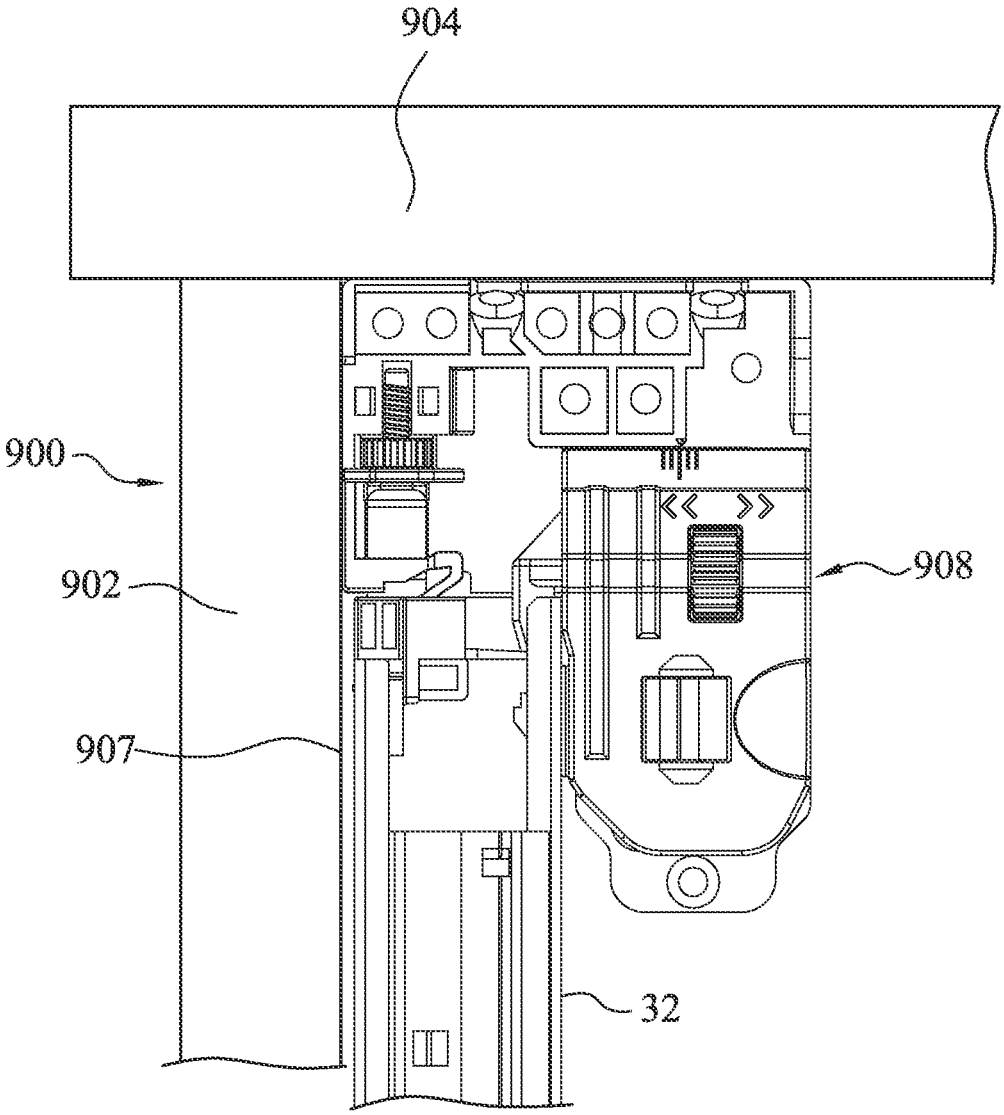
FIG. 13 is a fragmentary bottom view illustrating a regulating mechanism disposed on a bottom surface of the drawer and a front part of the guide rail mechanism.
Figure 14:
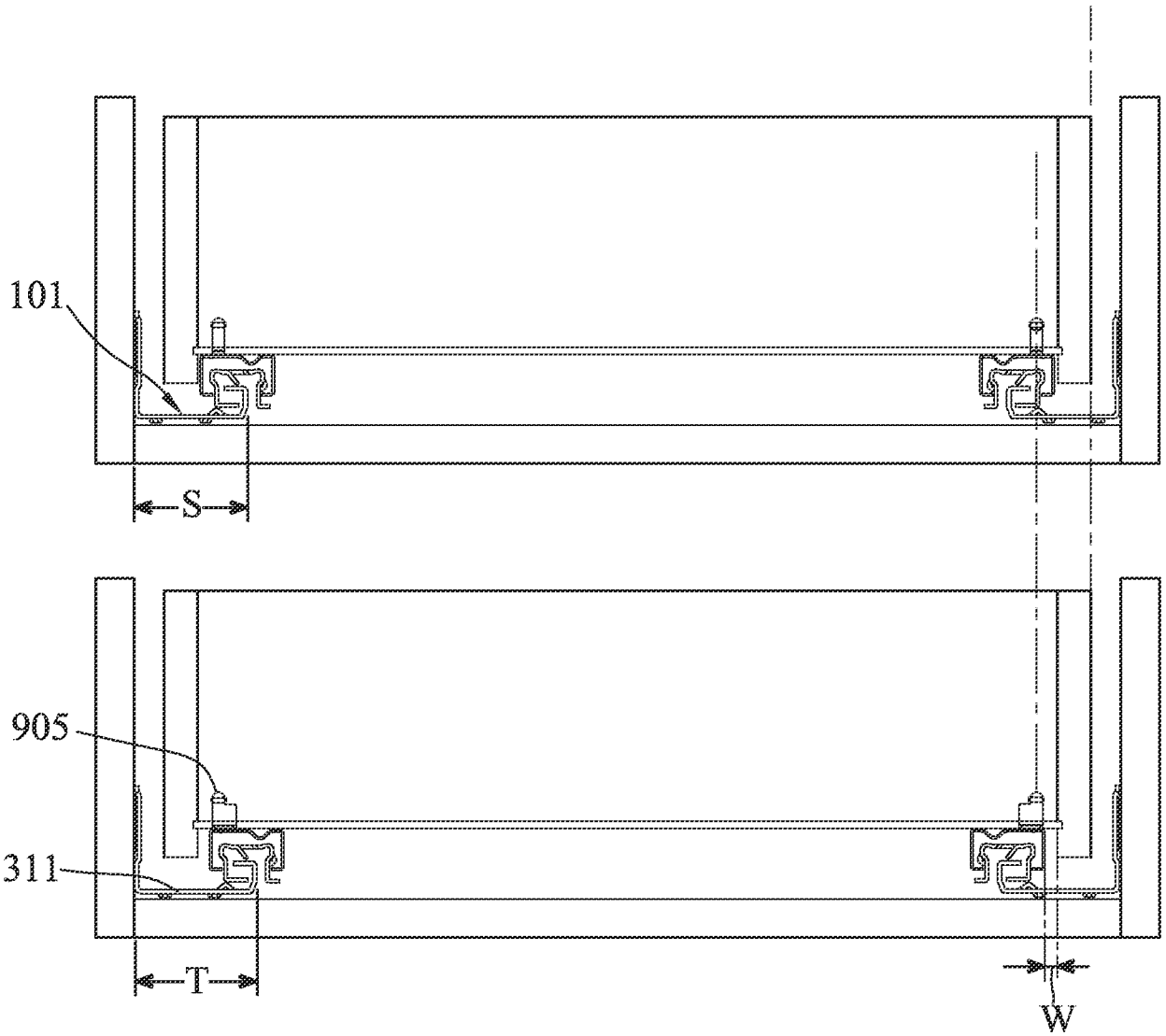
FIG. 14 is a schematic view illustrating the guide rail mechanisms of prior art in FIG. 4 and the embodiment in FIG. 12.
Figure 16:
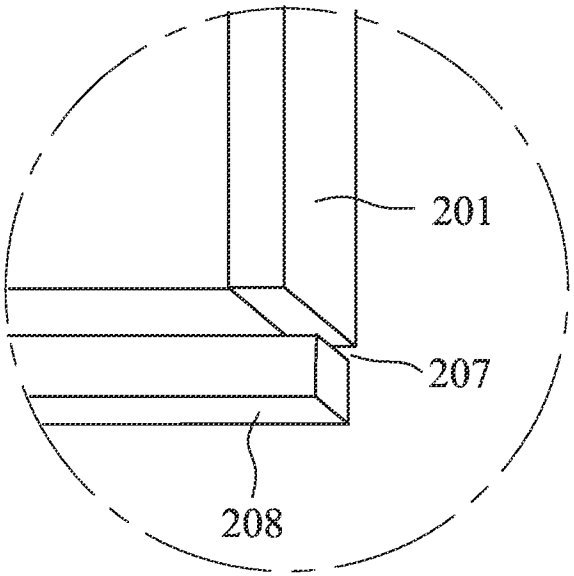
FIG.16 PRIOR ART
FIG. 16 is an enlarged perspective view illustrating a lower right portion of FIG. 5.
Figure 15:
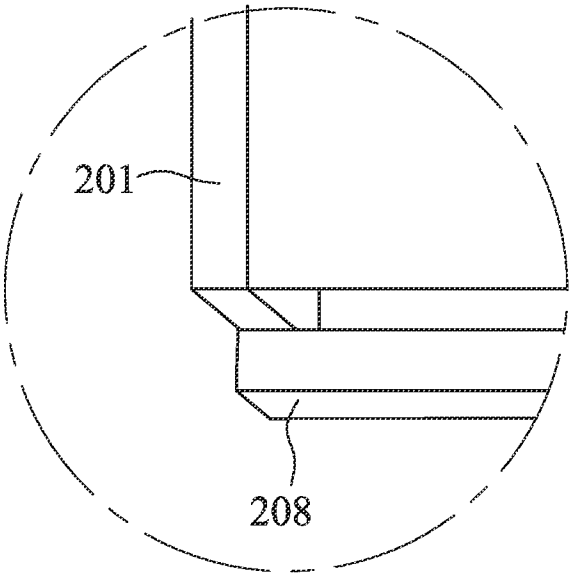
FIG.15 PRIOR ART
FIG. 15 is an enlarged perspective view illustrating a lower left portion of FIG. 5.
Figure 17:
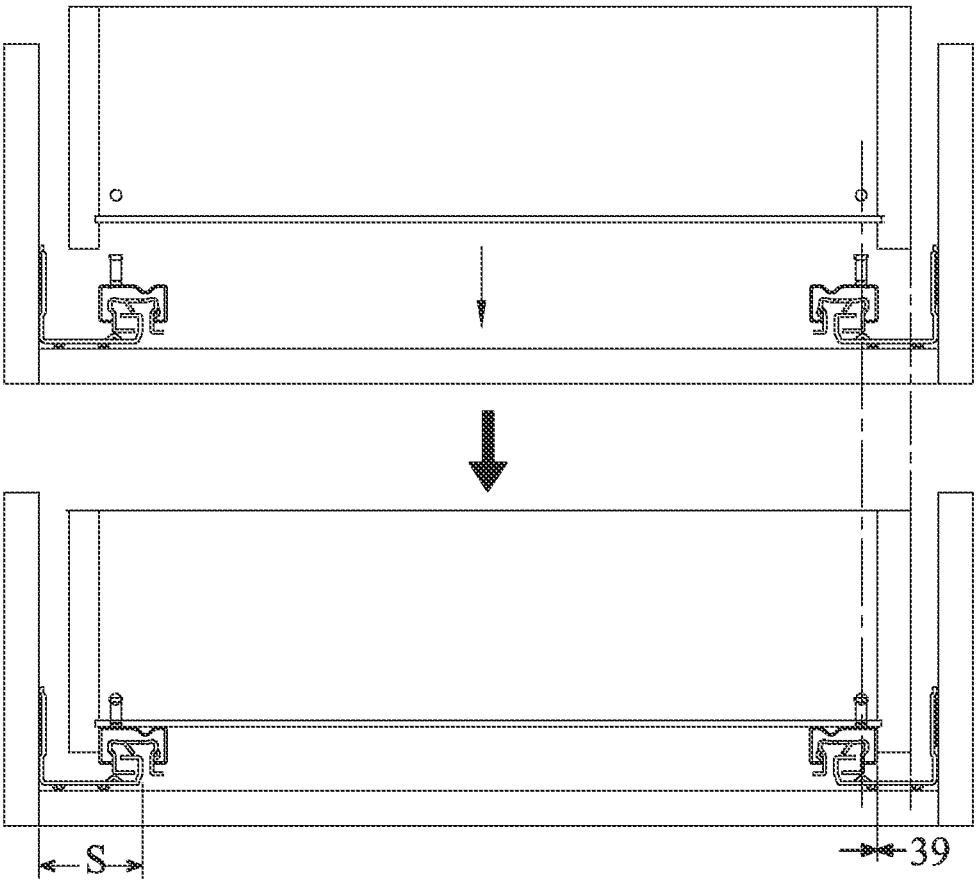
FIG.17 PRIOR ART
FIG. 17 is a schematic view illustrating an installation process for mounting two of the conventional guide rail mechanisms in FIG. 4 on a furniture carcass.
Figure 18:
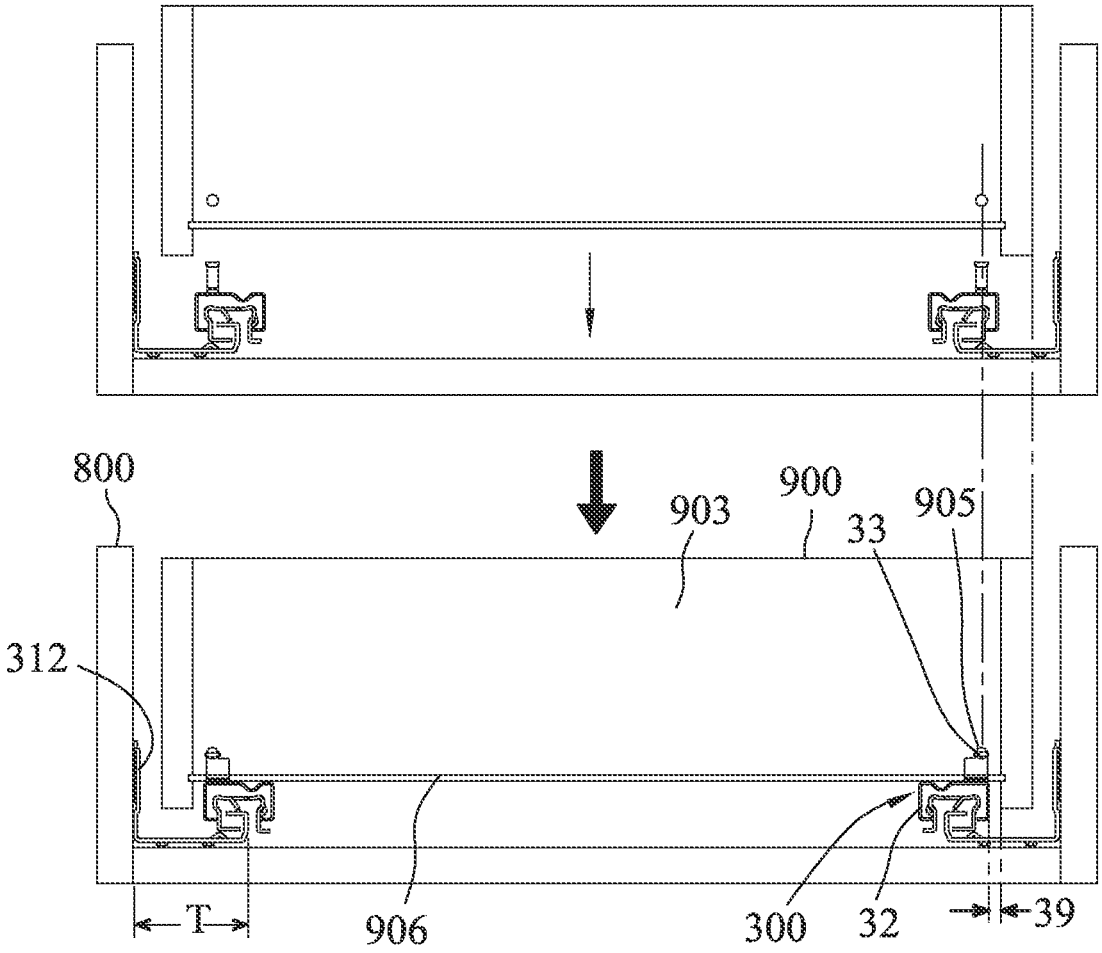
FIG. 18 is a schematic view illustrating an installation process for mounting two of the guide rail mechanisms of the embodiment in FIG. 7 on a furniture carcass.

Referring to FIGS. 6, 7 and 8, an embodiment of a guide rail mechanism 300 is adapted to be connectable between a furniture carcass 800 and a movable furniture part 900, such as a drawer 900, for guiding movement of the drawer 900 relative to the furniture carcass 800 in a front-rear direction. Two of the guide rail mechanisms 300 of the embodiment are used and disposed spaced apart from each other in a left-right direction. The furniture carcass 800 has two upright walls 801 spaced apart from each other in the left-right direction. The drawer 900 has left and right lateral walls 901, 902 which are spaced apart from each other in the left-right direction and each of which extends in the front-rear direction, a front panel 904 (as shown in FIG. 13) and a rear wall 903 which interconnect the left and right lateral walls 901, 902 and which are spaced apart from each other in the front-rear direction, and a bottom wall 906 which interconnects the left and right lateral walls 901, 902, the front panel 904 and the rear wall 903. Each of the left and right lateral walls 901, 902 further extends downwardly from the bottom edges of the bottom wall 906 and the rear wall 903. Two aligning holes 905 (as shown in FIG. 12) are formed in the rear wall 903 and are spaced apart from each other in the left-right direction. The left and right lateral walls 901, 902 respectively have lower inner abutting surfaces 907 facing each other.

The two guide rail mechanisms 300 are symmetrically mounted at left and right sides of the drawer 900. In the following description, a guide rail mechanism 300 disposed at the right side of the drawer 900, i.e., at the right upright wall 801 of the furniture carcass 800 and the right side of the drawer 900 is shown in FIGS. 6, 8, 9 and 10 for illustration.

The guide rail mechanism 300 includes a fixed rail unit 31 extending in the front-rear direction, a movable rail unit 32 slidably mounted on the fixed rail unit 31 in the front-rear direction, a tail hook 33 projecting from a top side of a rear end portion of the movable rail unit 32, and a mounting hole 34 disposed in a front end portion of the movable rail unit 32.

The fixed rail unit 31 includes a fixed rail body 311 extending in the front-rear direction, and a fixed wall 312 erected at and connected with a right side of the fixed rail body 311 to be securely mounted on the corresponding upright wall 801 of the furniture carcass 800. The movable rail unit 32 is slidably mounted on the fixed rail body 311, and is spaced leftwardly apart from the fixed wall 312 to cooperate with the fixed rail unit 31 to define a receiving space 30 having an upward opening.

The movable rail unit 32 has an outer concealed wall 321 adjacent to the lower inner abutting surface 907 of the drawer 900.

The tail hook 33 has an upwardly extending section 331 which extends upwardly from a top surface of the movable rail unit 32, and an insert section 332 which extends forwardly from an upper end of the upwardly extending section 331 to terminate at a striking tip 335. The insert section 332 is configured to have a largest width portion 338 which connects with the upwardly extending section 331 and which has a largest width (D) of the insert section 332 in the left-right direction, and a taper portion 334 which extends and is gradually tapered from the largest width portion 338 to the striking tip 335.

Figure 9:
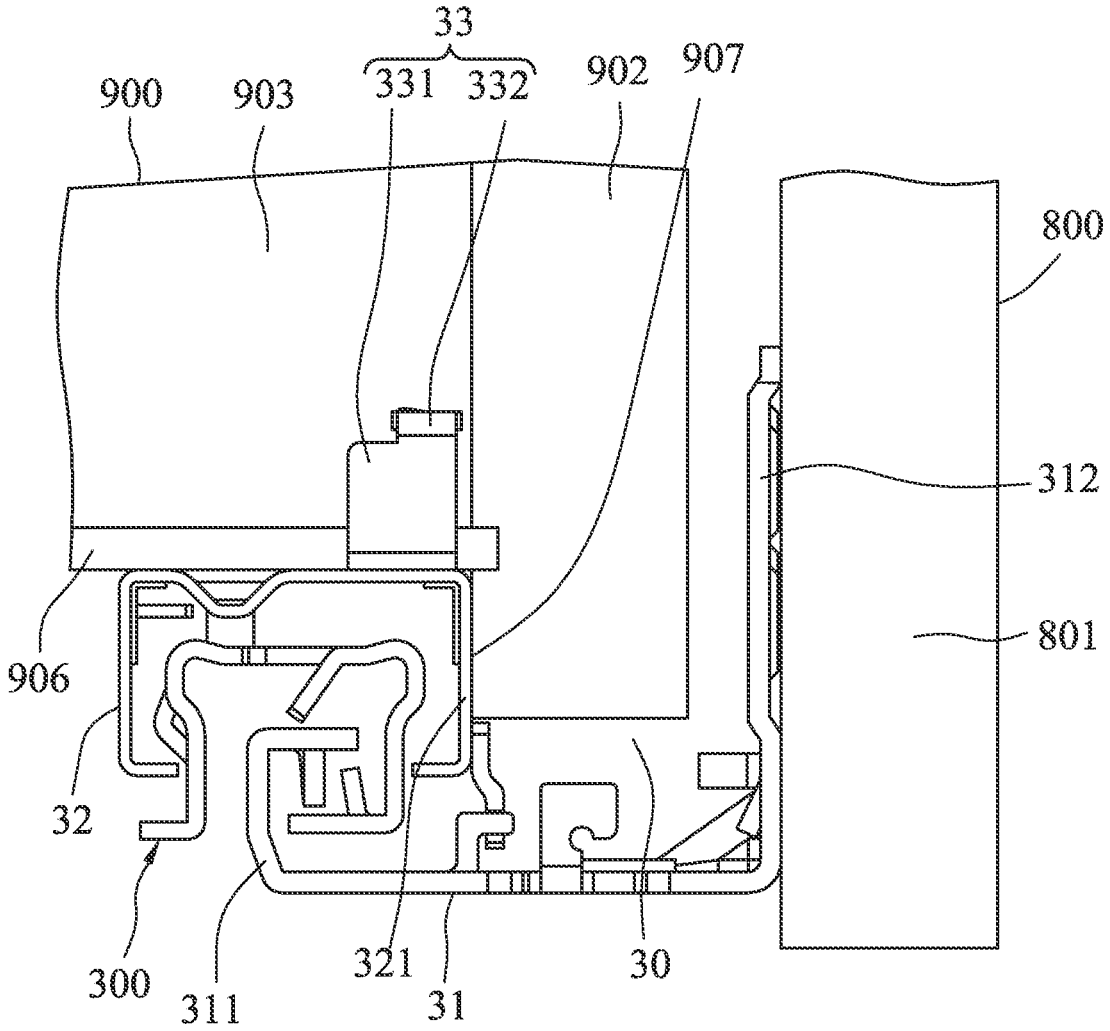
FIG. 9 is a fragmentary rear view illustrating a state when a movable rail unit of the embodiment abuts rightward against a right lateral plate of a drawer and the tail hook is moved forwardly to strike the drawer.

With reference to FIGS. 6, 8 and 9, the taper portion 334 is deflected leftwardly from a central line 700 which extends in the front-rear direction and through a center of the largest width portion 338 to form the striking tip 335 spaced apart from the central line 700 and formed at a side of the central line 700 away from the fixed wall 312. For example, the deflection length (W), i.e., the distance between the striking tip 335 and the central line 700 is smaller than or equal to a half of the largest width (D) of the largest width portion 338. The taper portion 334 has a longer bevel edge 336, at a right side, which extends forwardly and leftwardly from a side edge of the largest width portion 338, and a shorter bevel edge 337, at a left side, which extends forwardly and rightwardly from an opposite side edge of the largest width portion 338 to connect with the longer bevel edge 336 at the striking tip 335. The length of the longer bevel edge 336 is longer than the length of the shorter bevel edge 337. The longer bevel edge 336 has a bevel angle toward the central line 700 which is different from that of the shorter bevel edge 337. The longer bevel edge 336 is disposed between the shorter bevel edge 337 and the fixed wall 312.

In an installation procedure of two of the guide rail mechanisms 300 on an article of furniture, the guide rail mechanisms 300 having an appropriate receiving space 30 are selected according to the distance between the upright walls 801 of the furniture carcass 800 and the distance between the left and right lateral walls 901, 902 of the drawer 900. The fixed walls 312 of the guide rail mechanisms 300 are respectively fastened on the upright walls 801 of the carcass 800, and the left and right lateral walls 901, 902 of the drawer 900 are inserted respectively and downwardly into the receiving spaces 30 so as to movably straddle the movable rail units 32. The outer concealed walls 321 of the movable rail units 32 are respectively spaced apart from the lower inner abutting surfaces 907 of the left and right lateral walls 901, 902 by an adjustable space 39 with a width (W) (as shown in FIG. 7). At this stage, the drawer 900 is disposed forwardly of the tail hooks 33.

Figure 10:
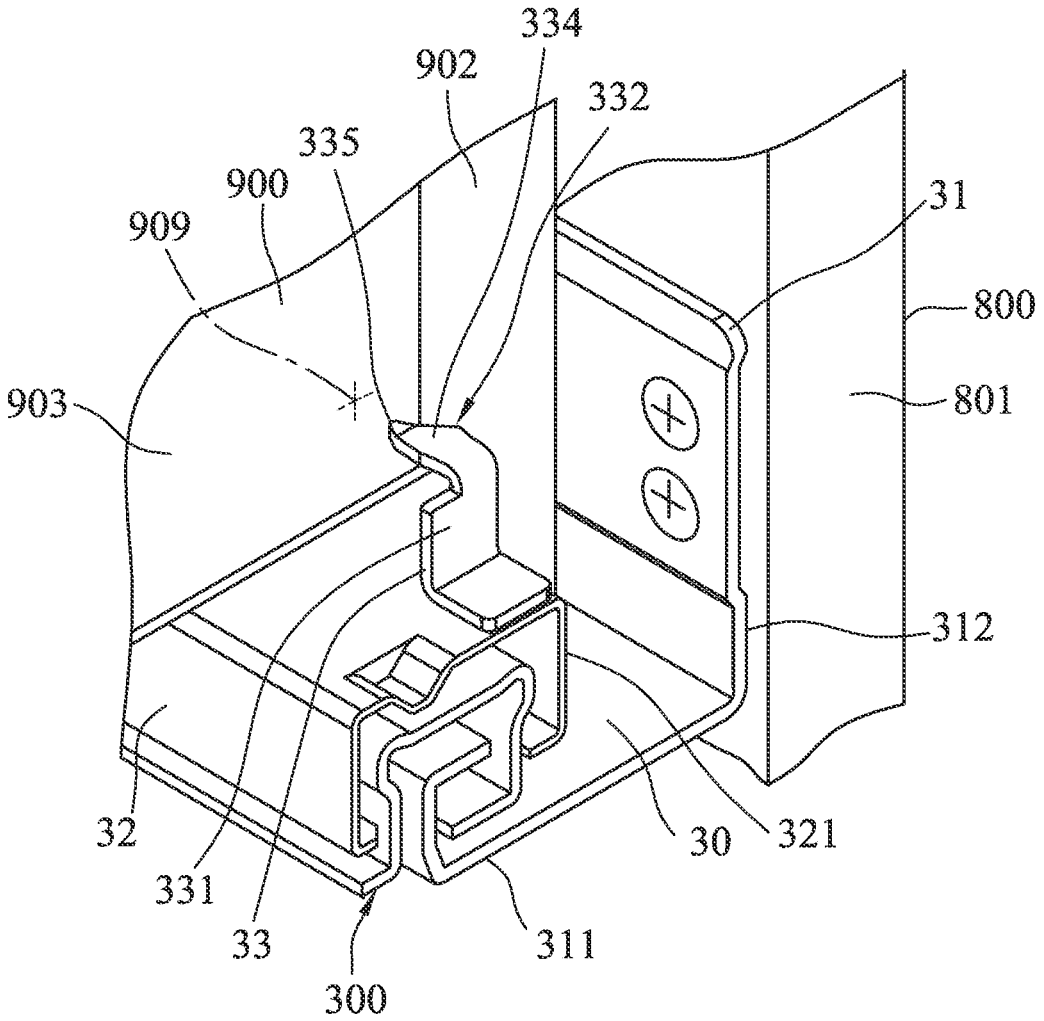
FIG. 10 is a fragmentary perspective view illustrating a state when the tail hook strikes the drawer and a striking point is formed.

With reference to FIGS. 8, 9 and 10, subsequently, the drawer 900 is moved leftwardly relative to the right guide rail mechanism 300 by a distance which is the width (W) such that the outer concealed wall 321 at the right side abuts rightwardly against the right lateral wall 902 of the drawer 900. The movable rail unit 32 is then moved forwardly relative to the drawer 900 to bring the striking tip 335 of the tail hook 33 to strike the rear wall 903 of the drawer 900 and to form on the rear wall 903 a striking point 909 that is marked for forming a right aligning hole.

Figure 11:
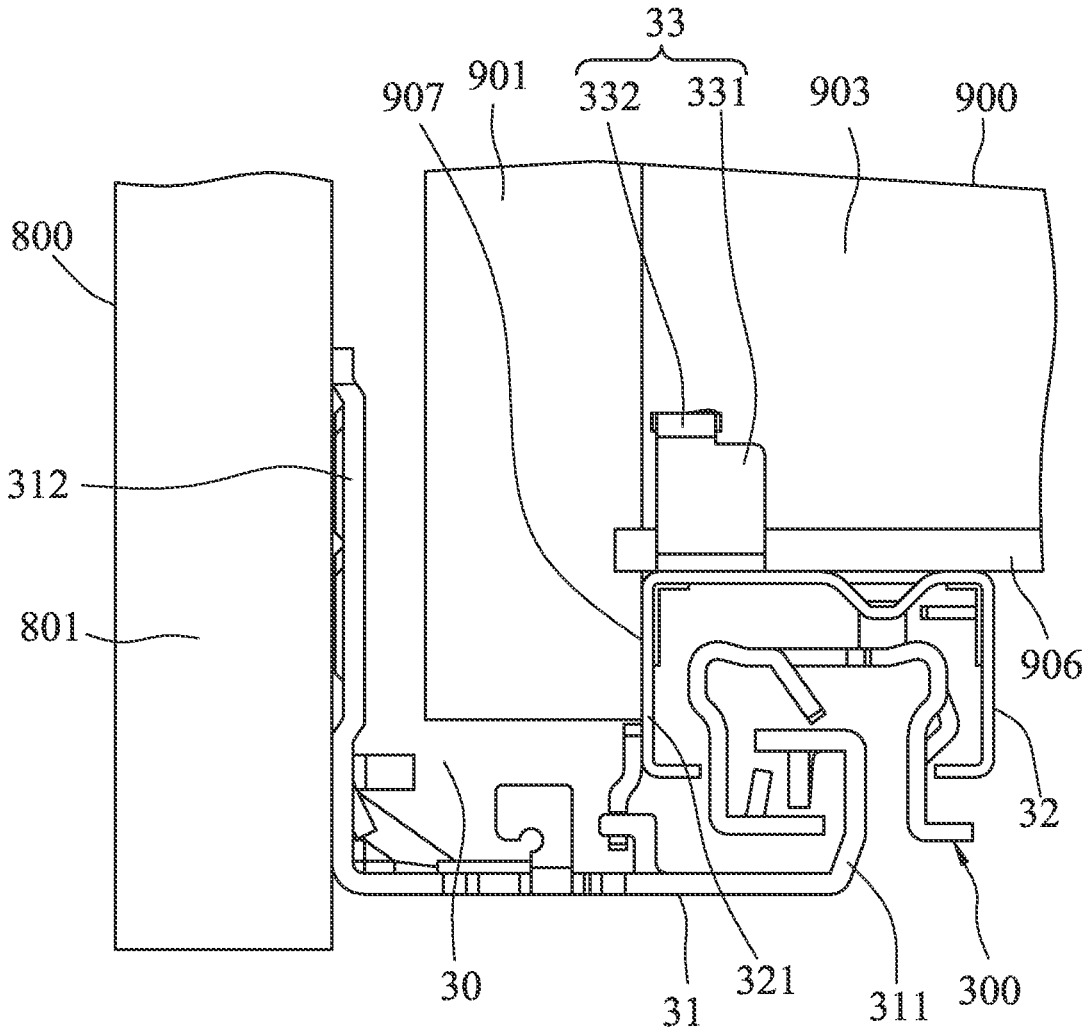
FIG. 11 is a fragmentary rear view similar to FIG. 9, illustrating a state when a movable rail unit of the embodiment abuts leftward against a left lateral plate of the drawer and a tail hook is moved forwardly to strike the drawer.

With reference to FIGS. 7, 10 and 11, subsequently, the drawer 900 is moved rightwardly relative to the left guide rail mechanism 300 by a distance which is the width (W) such that the outer concealed wall 321 at the left side abuts leftwardly against the left lateral wall 901 of the drawer 900. The movable rail unit 32 is then moved forwardly relative to the drawer 900 to bring the striking tip 335 of the tail hook 33 to strike the rear wall 903 of the drawer 900 and to form on the rear wall 903 a striking point 909 that is marked for forming a left aligning hole.

Figure 19:
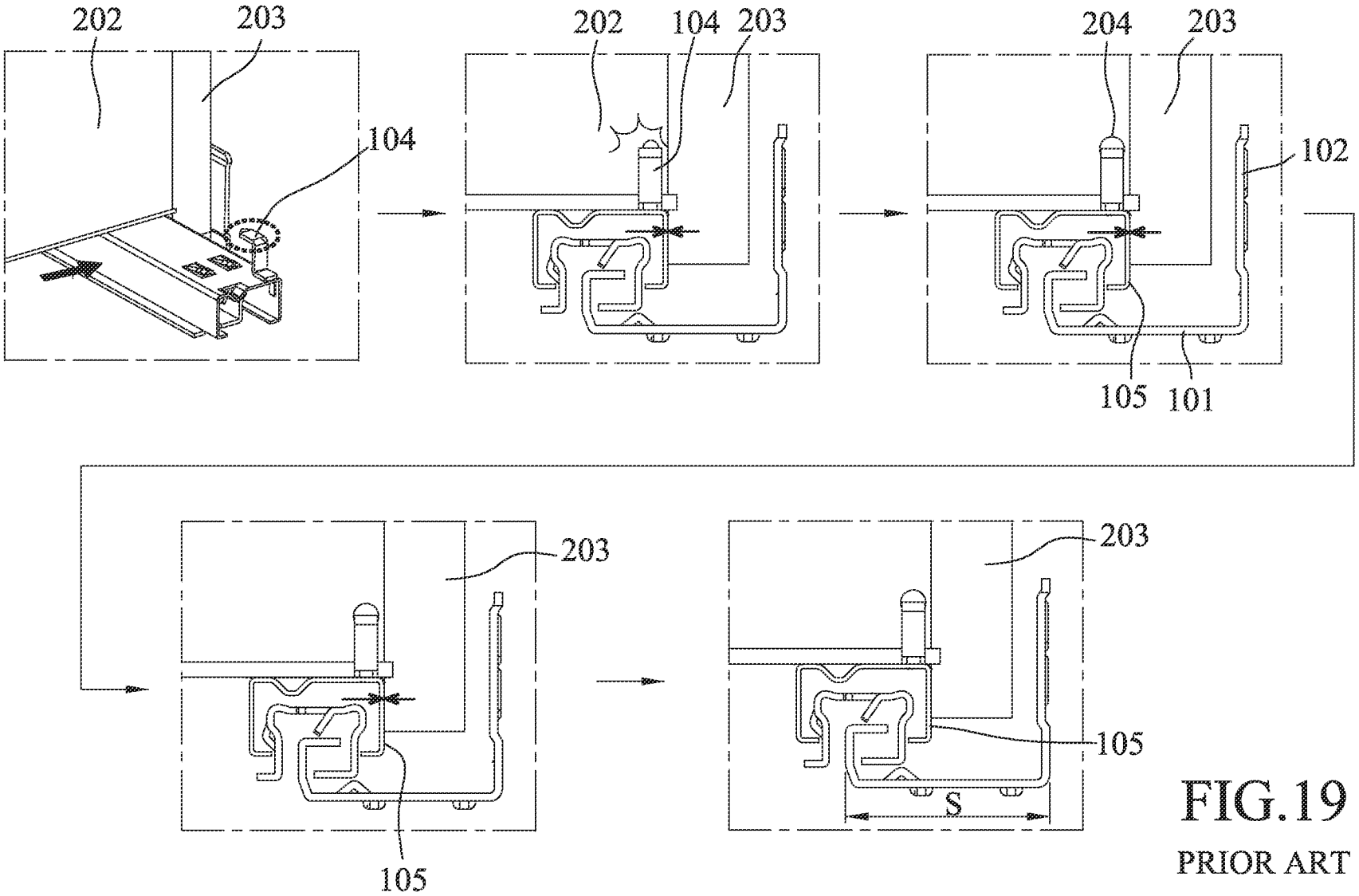
FIG. 19 PRIOR ART
FIG. 19 is a schematic view illustrating an installation process for mounting the conventional guide rail mechanism on a furniture carcass and a drawer.
Figure 20:
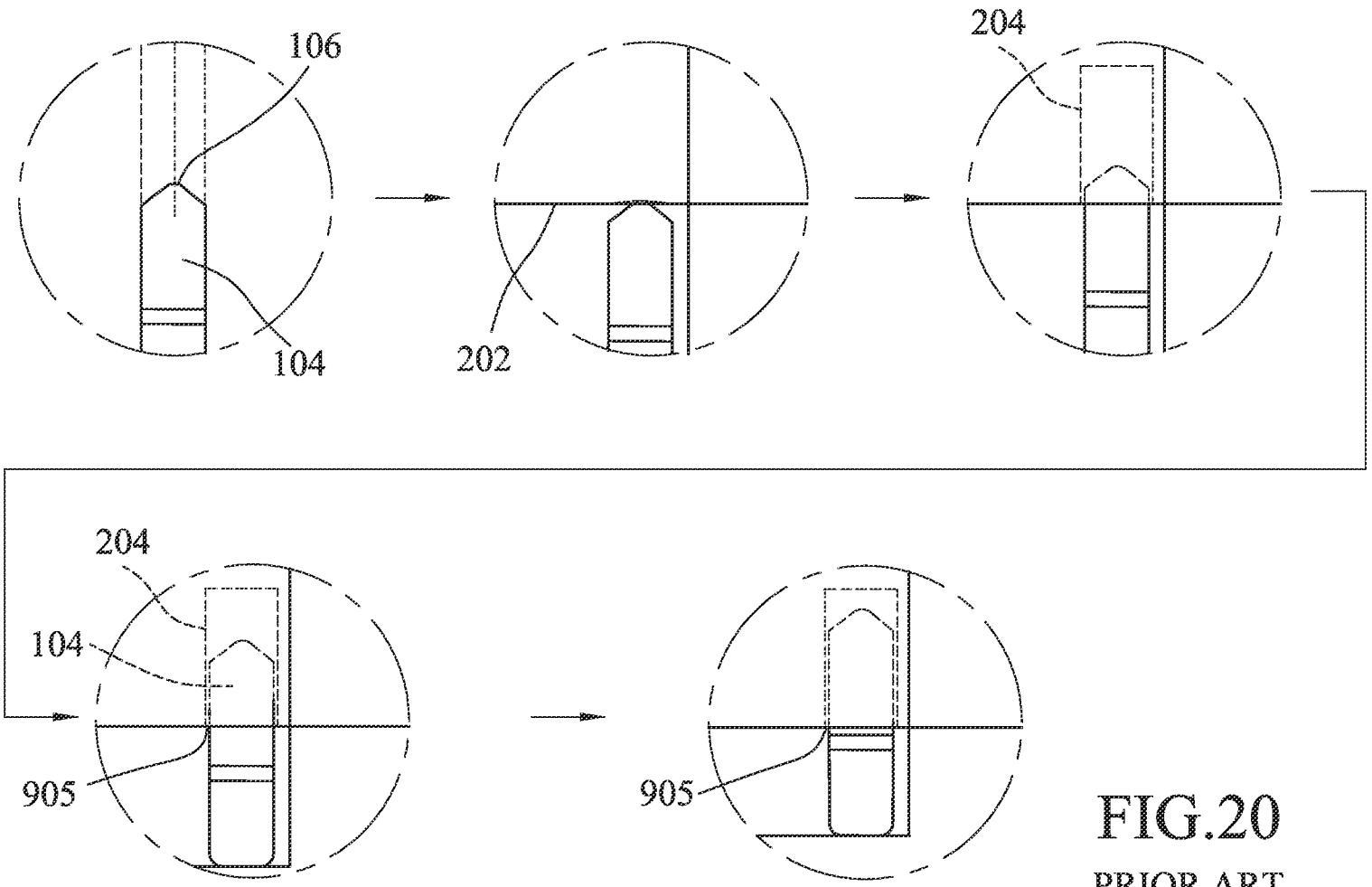
FIG.20 PRIOR ART
FIG. 20 is a schematic view illustrating an installation process for mounting a tail hook of the conventional guide rail mechanism in FIG. 19 on the drawer.
Figure 21:
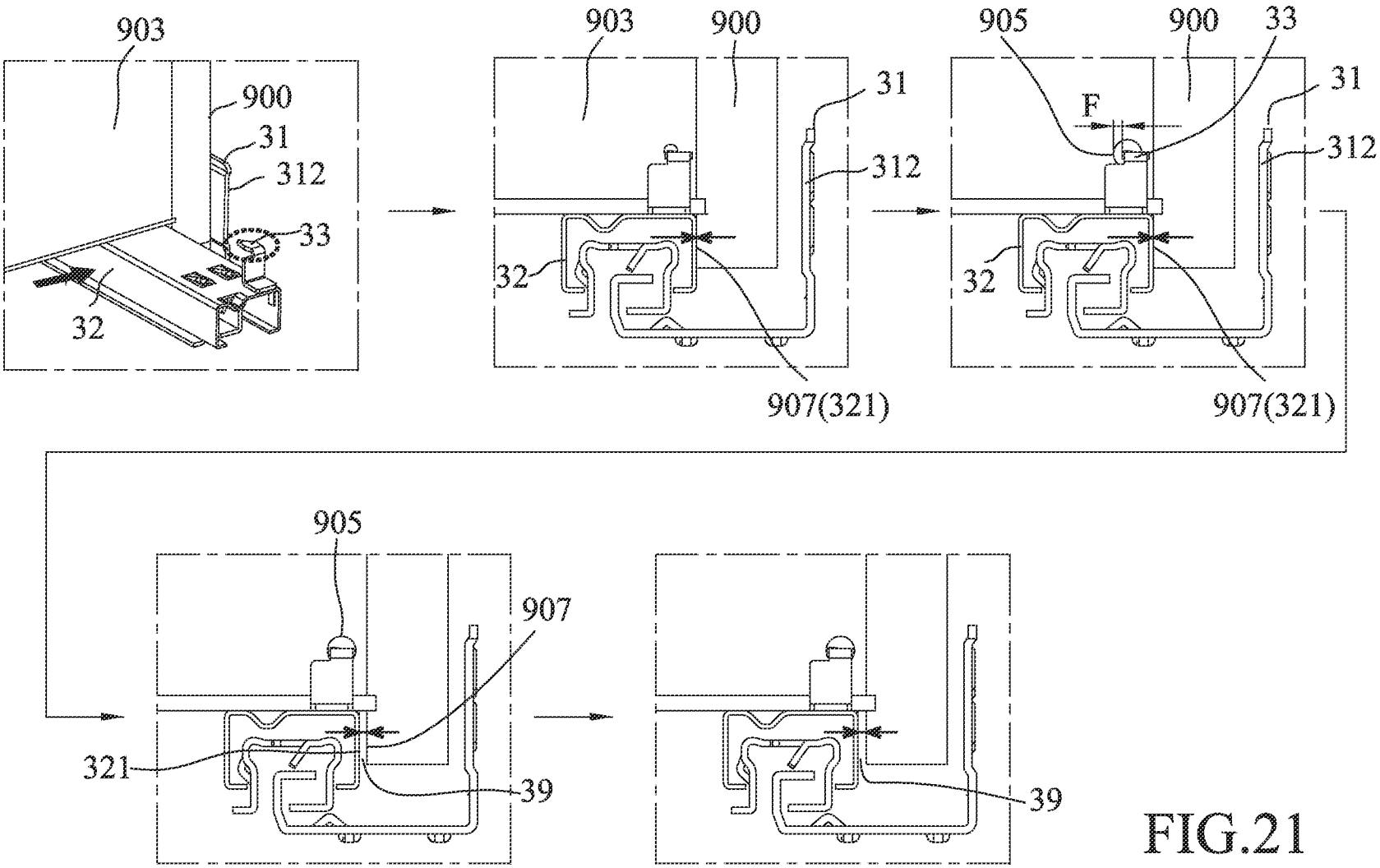
FIG. 21 is a schematic view illustrating an installation process for mounting the guide rail mechanism of the embodiment on a furniture carcass and a drawer.
Figure 22:
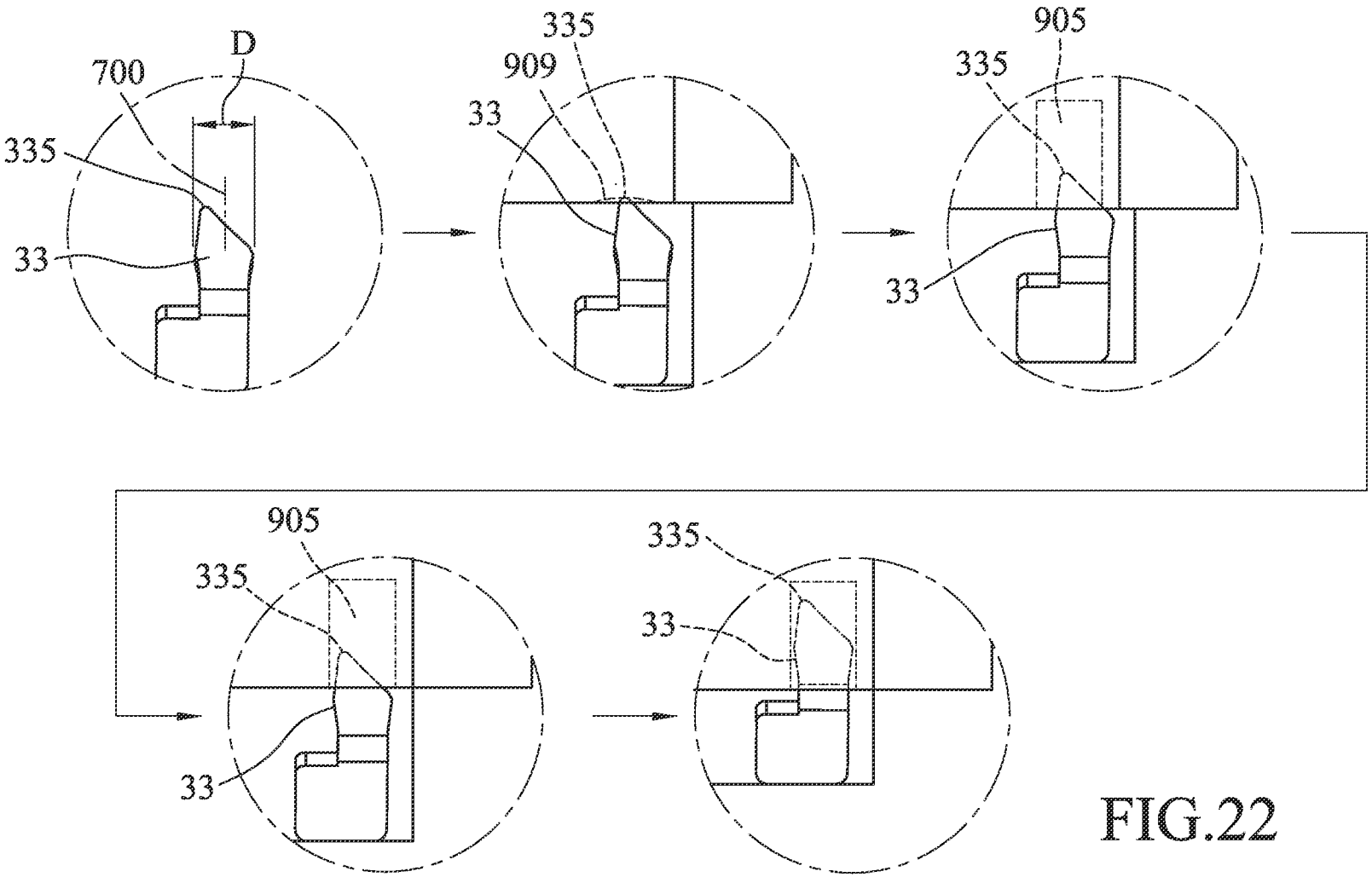
FIG. 22 is a schematic view illustrating an installation process for mounting a tail hook of the guide rail mechanism of the embodiment in FIG. 21 on the drawer.
Figure 23:
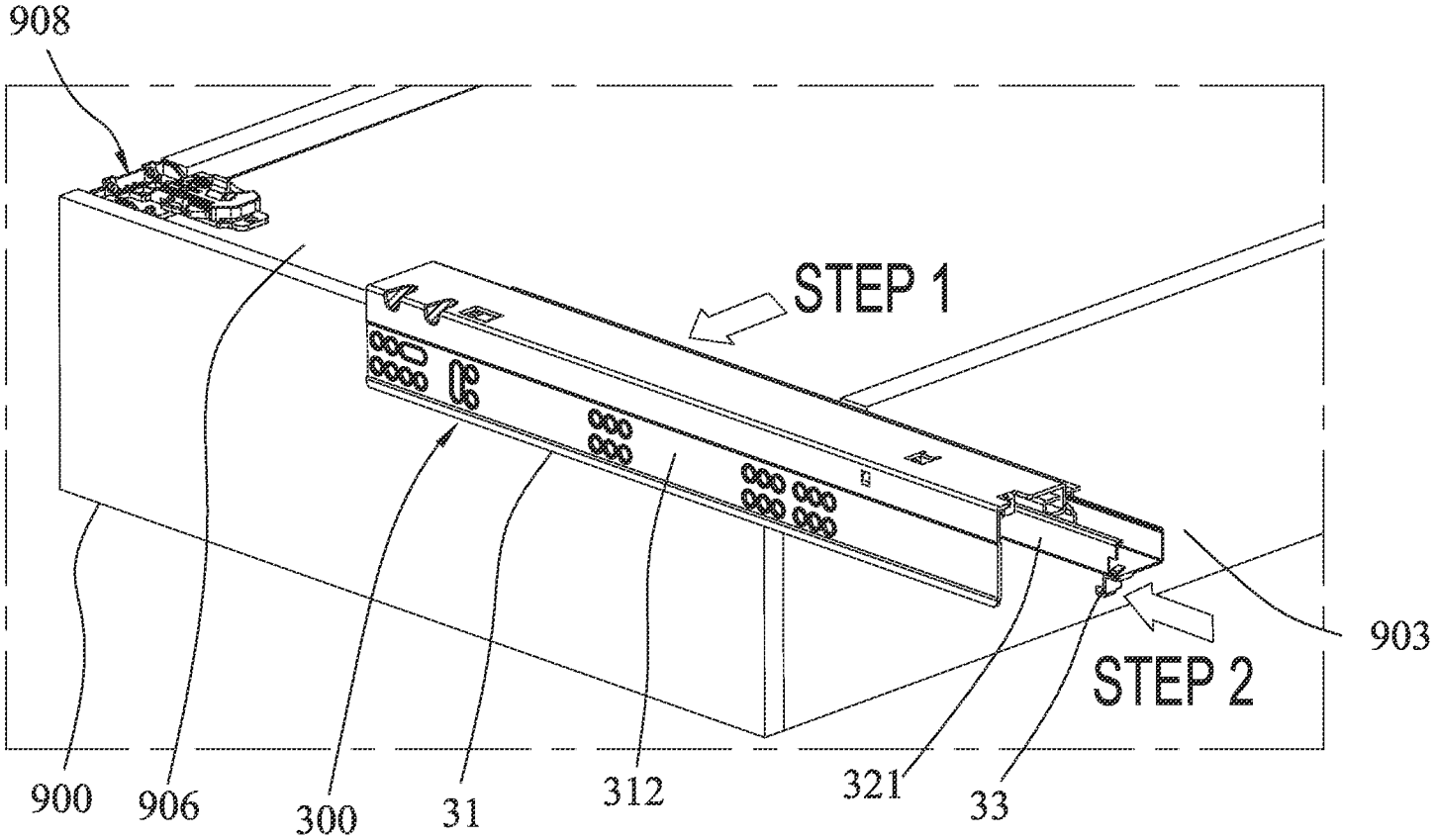
FIG. 23 is a fragmentary perspective view illustrating, in another installation process, the guide rail mechanism of the embodiment abutting against a drawer.
Figure 24:
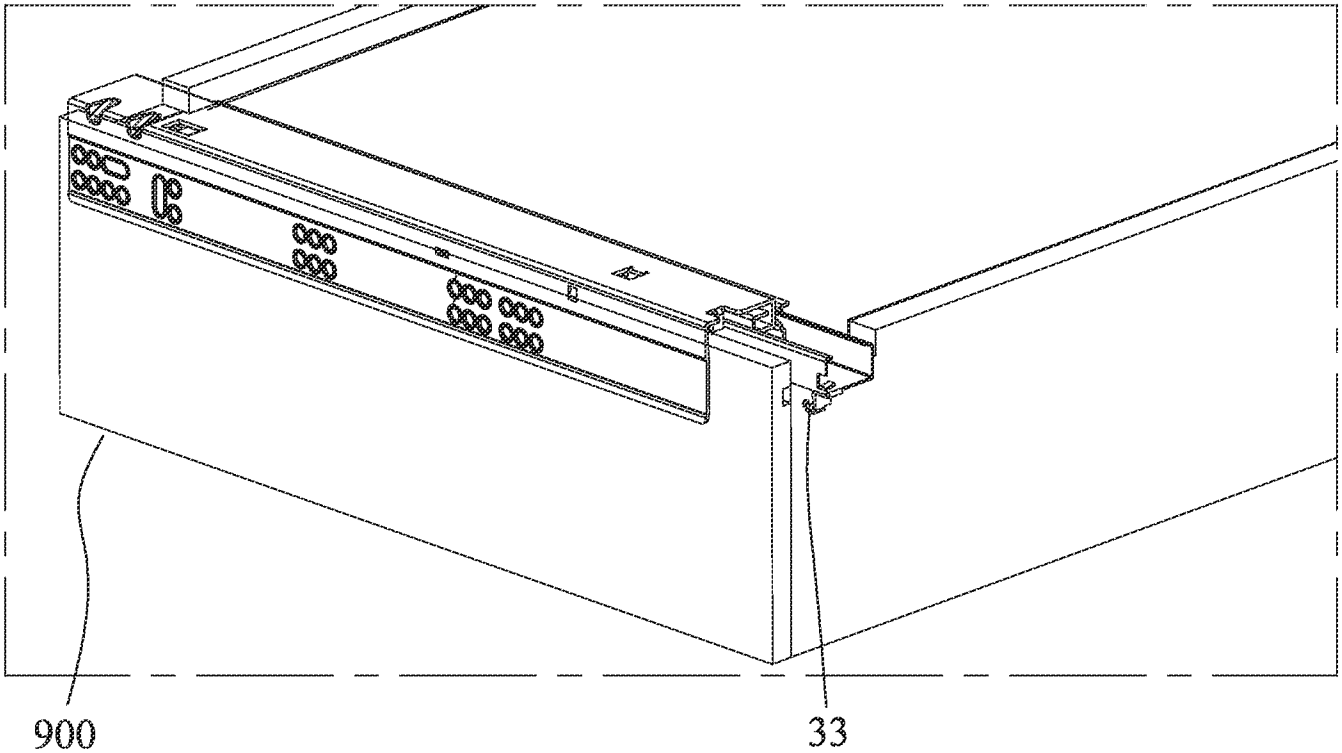
FIG. 24 is a fragmentary perspective view similar to FIG. 23, illustrating a state when a tail hook strikes the drawer.
Figure 25:
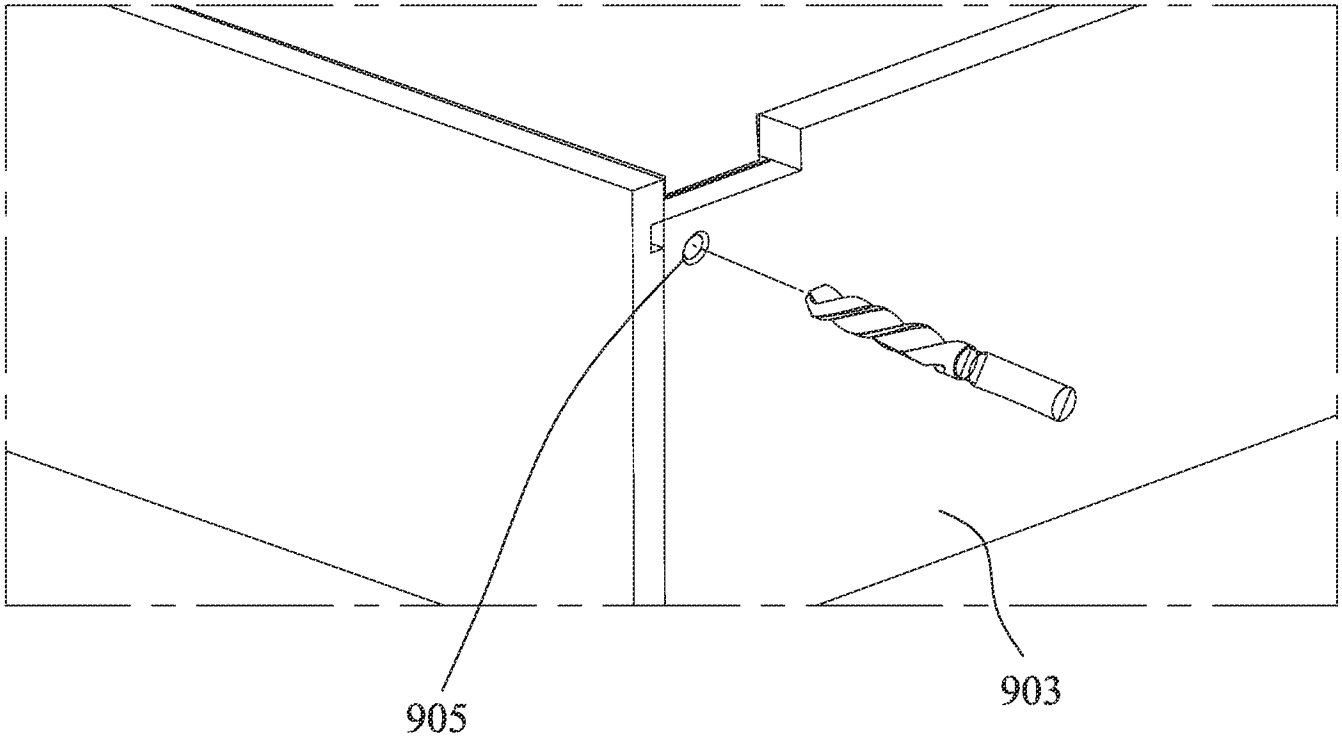
FIG. 25 is a fragmentary perspective view illustrating a state when a drill operated to form an aligning hole at the striking point of the drawer.
Figure 26:
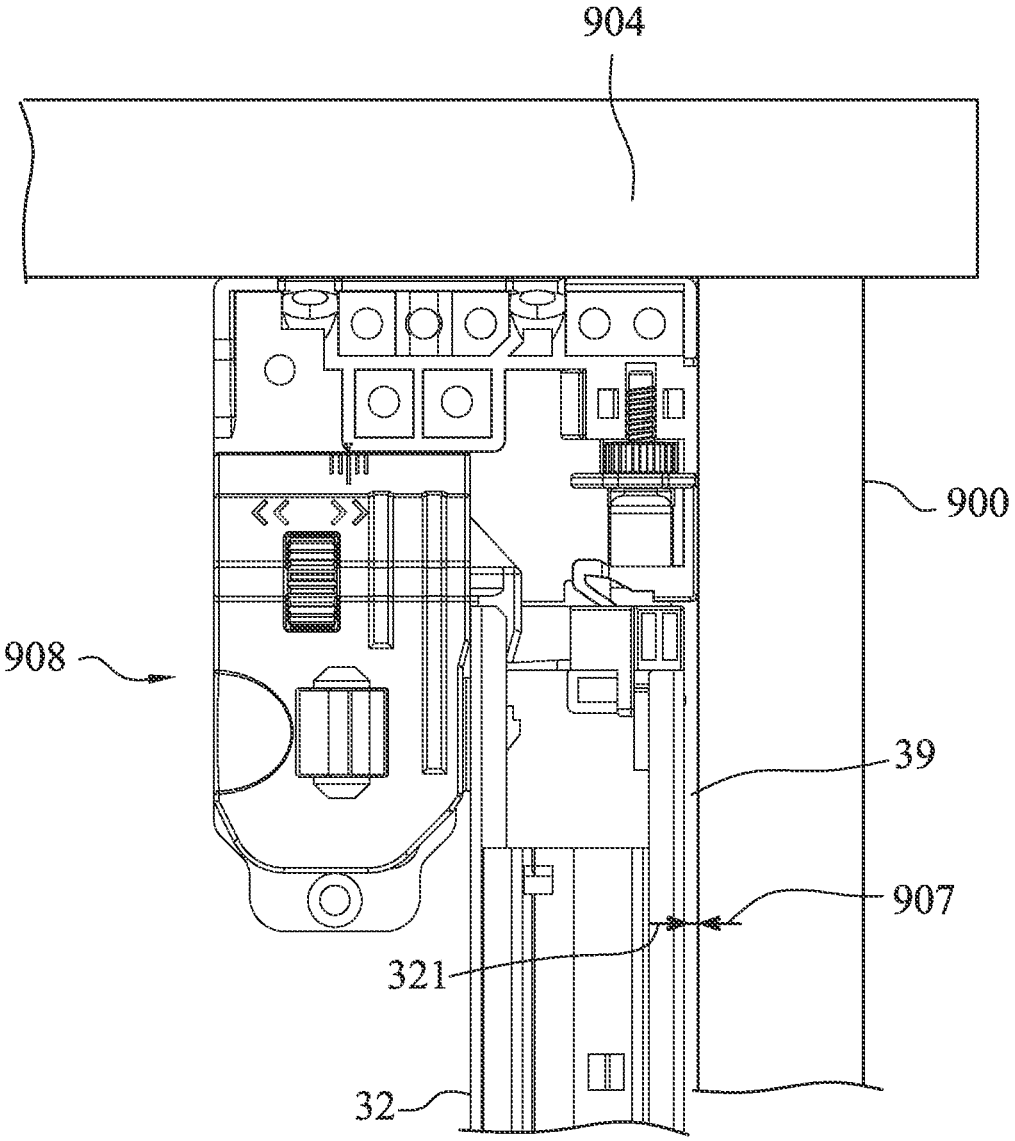
FIG. 26 is a fragmentary bottom view similar to FIG. 13, illustrating the guide rail mechanism of the embodiment mounted at the other side of the drawer.
Figure 27:
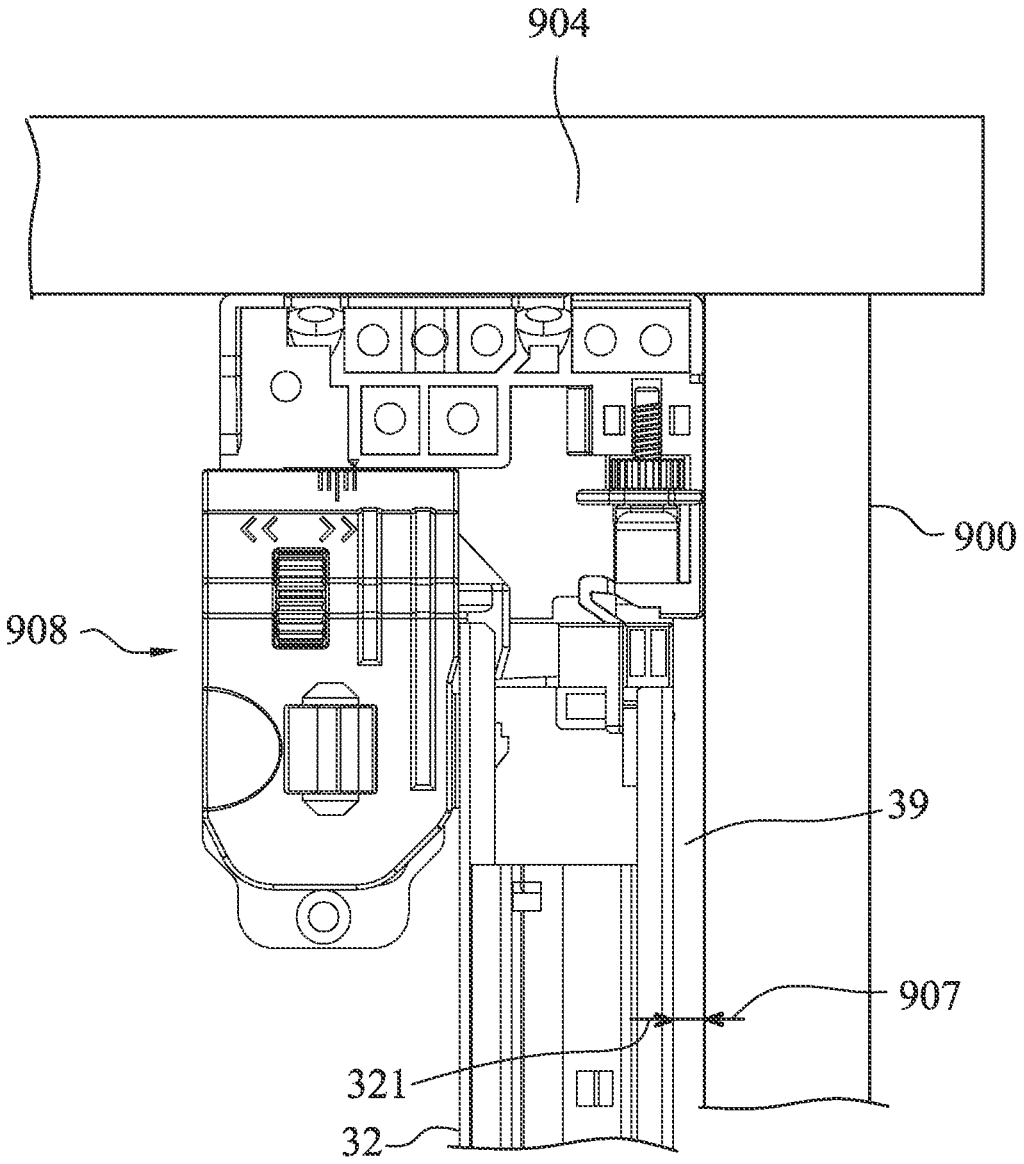
FIG. 27 is a fragmentary bottom view similar to FIG. 26, illustrating the embodiment moved away from a lower inner abutting surface of the drawer relative to the regulating mechanism.
Figure 28:
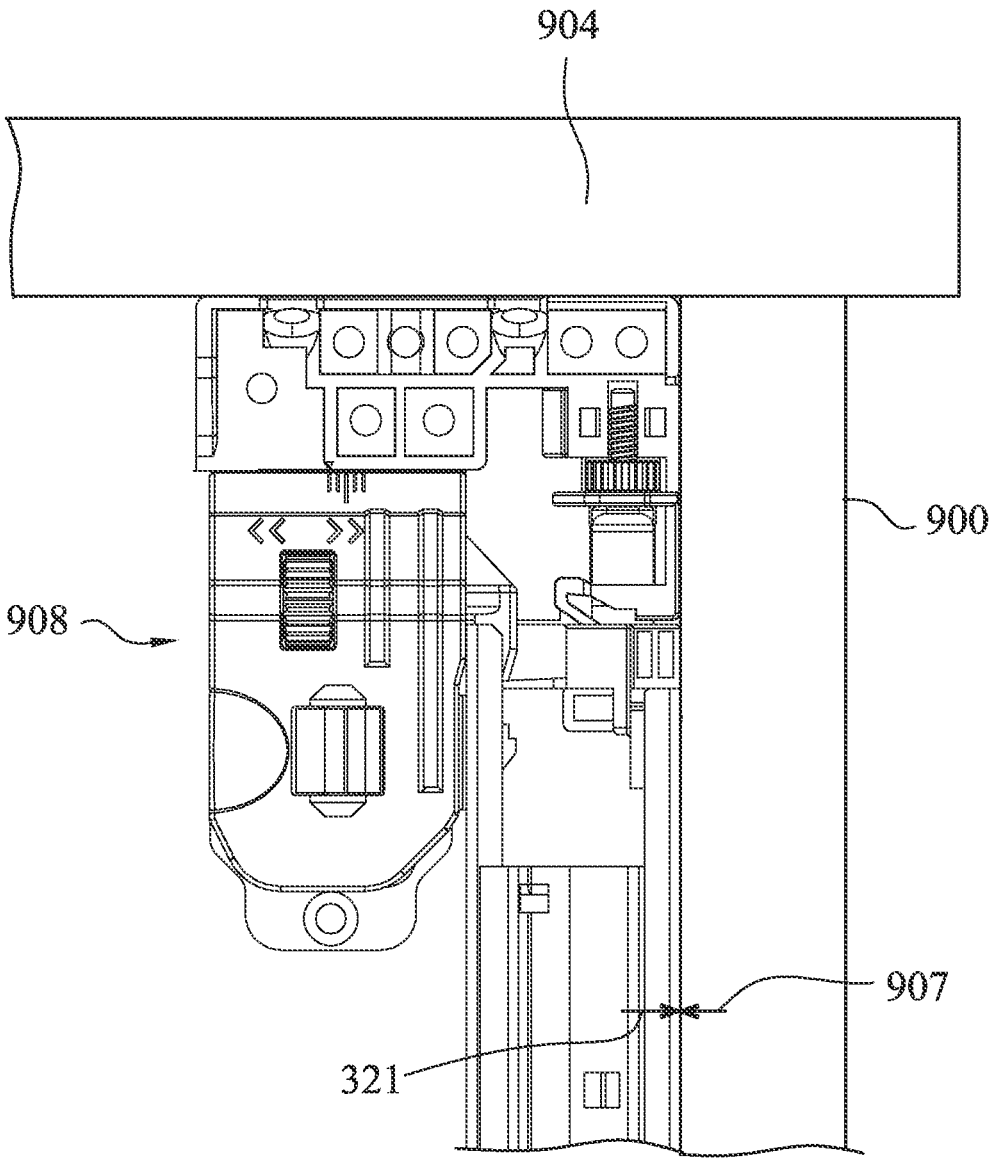
FIG. 28 is a fragmentary bottom view similar to FIG. 26, illustrating the embodiment moved close to the lower inner abutting surface of the drawer relative to the regulating mechanism.

With reference to FIGS. 10 and 12, next, a drill 200 (as shown in FIG. 25) is used to form the aligning holes 905 at the striking points in the rear wall 903. Finally, the drawer 900 is moved rearwardly such that the tail hooks 33 are inserted forwardly and respectively into the aligning holes 905. The installation process of the guide rail mechanisms 300 and the drawer 900 is illustrated in FIGS. 21 and 22, as compared with the prior art as shown in FIGS. 19 and 20. Alternatively, referring to FIGS. 23 to 25, in another installation process, before the guide rail mechanism 300 is mounted on the furniture carcass 800, the drawer 900 may be inverted, and the guide rail mechanism 300 is placed on the drawer 900 to determine the position of the aligning holes 905.

With reference to FIGS. 6, 13, 26, 27 and 28, a regulating mechanism 908 is mounted between a front end portion of the movable rail unit 32 and the drawer 900 for regulating the gap between the front panel 904 and the front edge of the furniture carcass 800. The regulating mechanism 908 is disposed at the bottom wall of the drawer 900, and is adjusted in the left-right direction. The regulating mechanism 908 engages with the mounting hole 34 of the movable rail unit 32 so as to retain the drawer 900 to the front end of the movable rail unit 32.

With reference to FIGS. 8, 10, 12, 14 and 18, in the embodiment, the taper portion 334 is deflected from the central line 700 of the largest width portion 338 such that the striking tip 335 is spaced apart from the central line 700 by a distance (W) such that the aligning hole 905 is displaced toward the center of the drawer 900 by a distance (W). That is, when the outer concealed wall 321 abuts against the right lateral wall 902, a displacement distance (F) exists between the edge of the tail hook 33 and the aligning hole 905 (as shown in FIG. 21). Hence, when the tail hook 33 is inserted into the aligning hole 905, the adjustable space 39 is created between the outer concealed wall 321 of the movable rail unit 32 and the lower inner abutting surface 907 of the corresponding lateral wall 901, 902. The adjustable space 39 has a width (W) in the left-right direction. The displacement distance (F) is equal to the width (W). Thus, the drawer 900 is slightly adjustable in the left-right direction relative to the movable rail unit 32 and the tail hook 33. As compared with the prior art, as shown in FIGS. 17 to 22, the fixed rail 101 in the prior art has a width (S). The fixed rail body 311 of the embodiment has a width (T) that is increased by a width (W) to be the same as the width (S). That is, T-S=W. Besides, the position of the tail hook 33 is formed closer to the fixed wall 312 by the distance (W). Hence, the guide rail mechanism 300 of the embodiment can be utilized in existing articles of furniture using the same installation and manufacturing processes so as to facilitate wide-spread adoption.

Therefore, when it is desired to adjust the drawer 900 due to an uneven attachment of the front panel 904 (see FIG. 13) on the front side of the furniture carcass 800 in the drawer closing state, the operation of the regulating mechanism 908 is still feasible. Alternatively, in a case where the drawer 900 has a smaller width, through changing the dimension of the adjustable space 39, the manufacturing tolerance of the drawer 900 can be accounted for and compensated so as to improve flexibility of installation.

In the above technical concept of the embodiment, firstly, to solve the problem of the gap between the front panel of the drawer and the furniture carcass, without increasing the pulling force of the biasing spring, the causes of the gap's formation is discovered and is eliminated as described above. That is, with the guide rail mechanism of the embodiment, the problem of the gap in the drawer can be solved without the need to increase the pulling force of the biasing spring, and hence the drawer can be opened with a gentle push.

With many years of experience in the furniture production industry conducting research and analysis on the integration of the slide rail structure, the inventor of the present disclosure has insightfully concluded that it is the guide rail mechanism 300 connected between the furniture carcass 800 and the drawer 900 for opening and closing the drawer 900, which results in the accumulation of manufacturing tolerances during manufacturing and assembly, and which will cause the two guide rail mechanisms 300 to be depressed horizontally and travel non-parallel, and that this is the main issue to be resolved. Furthermore, the inventor perceptively observed that under the state when the fixed rail unit 31 is securely fastened on the lateral wall 801 of the furniture carcass 800, and when the outer concealed wall 321 of the movable rail unit 32 abuts and contacts the lower inner abutting surface 907 of the drawer 900, the movable rail units 32 are depressed or spreaded so as to be not smoothly slidable along the fixed rail units 31. Therefore, the inventor became astutely aware that the resolution to the problem would require an adjustable moving space between the movable rail unit and the fixed rail unit to compensate for the tolerance accumulations.

Moreover, during the installation process, the tail hook 33 of the movable rail unit 32 is inserted into the aligning hole 905 of the rear wall of the drawer 900 which is formed by drilling the rear wall at a striking point that is marked by movement of the tail hook 33. The operator drills the rear wall of the drawer to form the aligning hole, which may result in a further manufacturing tolerance to account for; one that may cause deflection of the tail hook 33 of the movable rail unit 32. However, this existing assembling process has been performed for many years in the industry, leading it to become a standardized process and difficult to modify. Thus, without modifying the assembling process, the inventor observantly concluded that the tail hook 33 needs to be improved to eliminate a source of interference that causes deflecting movement of the movable rail unit 32 relative to the fixed rail unit 31. Likewise, an adjustable space 39 must be provided so that there is space for regulating the deflection. The adjustable space 39 is provided from the deflection of the striking tip 335 of the tail hook 33 away from the width of the central line 700. Therefore, without changing the existing assembling process, an adjustable space 39 can be formed between the outer concealed wall 321 of the movable rail unit 32 and the lower inner abutting surface 907 of the drawer 900.

Through the adjustable space 39, the guide rail mechanism 300 which is connected between the furniture carcass 800 and the drawer 900 with unpredictable tolerance accumulations is adjustable to compensate for the tolerance without the need to increase the pulling force of the biasing spring to pull the front panel 904 (see FIG. 13) of the drawer 900 for minimizing the gap. Thus, the pulling force of the biasing spring can be reduced and the user can open the drawer 900 with a small force applying to a relatively smaller operating area of the front panel 904.

As illustrated, with the taper portion 334 of the tail hook 33 tapered and deflected from the central line 700 of the width to have the striking tip 335 spaced apart from the central line 700 and away from the fixed wall 312, and with the movable rail unit 32 spaced apart from the corresponding lateral wall 901, 902 of the drawer 900, the drawer 900 is adjustable relative to the furniture carcass 800 to overcome the manufacturing and assembling tolerances interfering with the sliding of the guide rail mechanism 300 due to.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A guide rail mechanism connectable between a furniture carcass and a movable furniture part for guiding movement of the movable furniture part relative to the furniture carcass in a front-rear direction, comprising:

a fixed rail unit having a fixed wall which is securely mountable on the furniture carcass;

a movable rail unit slidably mounted on said fixed rail unit in the front-rear direction, and spaced apart from said fixed wall in a left-right direction; and a tail hook projecting from a top side of a rear end portion of said movable rail unit, said tail hook having an upwardly extending section which extends upwardly from said movable rail unit, and an insert section which extends forwardly from said upwardly extending section to terminate at a striking tip, said insert section being configured to have a largest width portion which connects with said upwardly extending section and which has a largest width of said insert section in the left-right direction, and a taper portion which extends and is gradually tapered from said largest width portion to said striking tip, said taper portion being deflected from a central line which extends in the front-rear direction and through a center of said largest width portion to form said striking tip spaced apart from the central line and at a side of the central line away from said fixed wall, said taper portion having a longer bevel edge which extends from a side edge of said largest width portion over the central line, and a shorter bevel edge which extends from an opposite side edge of said largest width portion toward the central line, which connects with said longer bevel edge at said striking tip and which has a length shorter than said longer bevel edge, said longer bevel edge being disposed between said shorter bevel edge and said fixed wall.

2. The guide rail mechanism as claimed in claim 1, wherein said longer bevel edge has a bevel angle toward the central line which is different from that of said shorter bevel edge.

* * * * *